US012066224B2

(12) United States Patent
Piggush

(10) Patent No.: US 12,066,224 B2
(45) Date of Patent: Aug. 20, 2024

(54) EVAPORATOR CHARGE MANAGEMENT AND METHOD FOR CONTROLLING THE SAME

(71) Applicant: TRANE INTERNATIONAL INC., Davidson, NC (US)

(72) Inventor: Justin D. Piggush, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 56 days.

(21) Appl. No.: 17/832,266

(22) Filed: Jun. 3, 2022

(65) Prior Publication Data

US 2023/0392837 A1 Dec. 7, 2023

(51) Int. Cl.
*F25B 39/02* (2006.01)

(52) U.S. Cl.
CPC ..... *F25B 39/028* (2013.01); *F25B 39/022* (2013.01); *F25B 2339/0242* (2013.01)

(58) Field of Classification Search
CPC ..... F25B 39/028; F25B 39/022; F25B 2339/0242
See application file for complete search history.

(56) References Cited

U.S. PATENT DOCUMENTS 3,257,817 A * 6/1966 Leonard, Jr. ..... F25B 47/006 62/502
3,623,505 A * 11/1971 Barsness ..... B01J 8/0278 165/174
4,630,776 A * 12/1986 Findling ..... B01D 21/0042 239/553.3
4,843,837 A * 7/1989 Ogawa ..... F28D 7/0066 62/503
5,261,485 A * 11/1993 Thornton ..... F28D 7/1669 165/158
5,415,223 A * 5/1995 Reavis ..... F25B 39/028 165/96
6,167,713 B1 * 1/2001 Hartfield ..... F25B 39/028 165/DIG. 171

(Continued)

FOREIGN PATENT DOCUMENTS

| | | |
|---|---|---|
| CN | 104457035 B | 8/2016 |
| DE | 102013010510 A1 | 3/2014 |
| WO | 2011/007606 A1 | 1/2011 |

OTHER PUBLICATIONS

Gallant et al., U.S. Appl. No. 17/649,652, filed Feb. 1, 2022 (34 pages).

(Continued)

*Primary Examiner* — Raheena R Malik
(74) *Attorney, Agent, or Firm* — HSML P.C.

(57) ABSTRACT

An evaporator includes a housing having a first end longitudinally opposing a second end. The evaporator includes an inlet disposed on the housing and configured to receive a fluid. The evaporator also includes a tube bundle disposed in the housing and configured to evaporate the fluid to provide a vapor stream arranged to exit through an outlet on the housing. Additionally, the evaporator has a flow balancer provided between the tube bundle and the outlet on the housing, and the flow balancer is configured to balance refrigerant quality between the first end and the second end of the evaporator by controlling the vapor stream.

18 Claims, 13 Drawing Sheets

(56) References Cited

U.S. PATENT DOCUMENTS 6,293,112 B1 * 9/2001 Moeykens ..... F28D 3/04 62/84
6,516,627 B2 * 2/2003 Ring ..... F25B 31/004 62/193
6,532,763 B1 * 3/2003 Gupte ..... F28D 21/0017 62/515
6,830,099 B2 * 12/2004 Moeykens ..... F28D 3/02 62/84
6,868,695 B1 * 3/2005 Dingel ..... F28F 9/0278 62/515
7,275,394 B2 * 10/2007 Lundberg ..... F28F 9/028 62/515
7,421,855 B2 * 9/2008 Ring ..... F28F 9/0265 62/512
7,707,850 B2 * 5/2010 Wang ..... F28D 21/0017 62/515
8,176,750 B2 * 5/2012 Higashiyama ..... F25B 39/028 62/515
8,302,426 B2 11/2012 Larminat et al.
8,863,551 B2 * 10/2014 de Larminat ..... F25B 41/20 62/525
8,944,152 B2 * 2/2015 Kulankara ..... F28D 7/16 165/113
9,366,464 B2 * 6/2016 Sonninen ..... F25B 39/02
9,464,851 B2 * 10/2016 Provenziani ..... F28D 7/0066
9,466,506 B2 * 10/2016 Masuda ..... H01J 37/3244
9,631,871 B2 * 4/2017 Contet ..... F28F 9/0278
9,714,601 B2 * 7/2017 Masuda ..... F01P 11/028
10,132,537 B1 * 11/2018 Stamp ..... F25B 39/028
11,486,615 B2 * 11/2022 Huang ..... F28D 7/16
2004/0112573 A1 * 6/2004 Moeykens ..... F28D 3/02 165/118
2004/0159121 A1 * 8/2004 Horiuchi ..... F28F 9/0278 62/526
2005/0039901 A1 * 2/2005 Demuth ..... F28F 9/0278 165/173
2007/0107886 A1 * 5/2007 Chen ..... F28F 9/22 165/161
2008/0041096 A1 * 2/2008 Sakashita ..... F28D 21/0017 62/515
2009/0120627 A1 * 5/2009 Beamer ..... F28F 9/0278 165/174
2010/0206535 A1 * 8/2010 Munoz ..... F28F 9/0204 165/173
2011/0041528 A1 * 2/2011 Charbel ..... F28F 9/0265 62/115
2012/0118545 A1 * 5/2012 Ayub ..... F25B 39/02 165/159
2013/0112381 A1 * 5/2013 Valente ..... F28D 7/103 165/159
2014/0311721 A1 * 10/2014 Esformes ..... F28D 21/0017 165/159
2015/0013951 A1 * 1/2015 Numata ..... F28D 7/16 165/157
2015/0153115 A1 * 6/2015 Kayser ..... F28D 21/0017 165/157
2017/0138652 A1 * 5/2017 Hattori ..... F28F 9/00
2017/0153061 A1 * 6/2017 Yoshioka ..... F28D 3/04
2017/0254573 A1 * 9/2017 Numata ..... F25B 39/028
2017/0320708 A1 * 11/2017 Dong ..... B66C 23/203
2019/0195541 A1 * 6/2019 Moore ..... F25B 39/02
2020/0056817 A1 * 2/2020 Huang ..... F28D 7/16
2020/0200478 A1 * 6/2020 Wilson ..... F28D 1/05391
2022/0170704 A1 * 6/2022 Hall ..... F25B 39/028

OTHER PUBLICATIONS

Extended European Search Report, European Patent Application No. 23177110.6, Oct. 24, 2023 (8 pages).

* cited by examiner

EVAPORATOR CHARGE MANAGEMENT AND METHOD FOR CONTROLLING THE SAME

FIELD

This disclosure relates to heat exchangers. More specifically, this disclosure relates to managing the refrigerant charge in the housing of heat exchangers utilized in heating, ventilation, air conditioning, and refrigeration ("HVACR") systems.

BACKGROUND

HVACR systems are generally used to provide environmental control of an enclosed space (e.g., an interior space of a commercial building or a residential building, an interior space of a refrigerated transport unit, or the like). An HVACR system may include a heat transfer circuit that utilizes a working fluid for providing cooled or heated air or water to an area. The heat transfer circuit includes an evaporator. The evaporator is configured to evaporate the working fluid to create a vapor stream.

SUMMARY

This disclosure relates to heat exchangers. More specifically, this disclosure relates to managing the refrigerant charge in the housing of heat exchangers utilized in heating, ventilation, air conditioning, and refrigeration ("HVACR") systems.

In some embodiments, an evaporator includes a housing having a first end longitudinally opposing a second end. An inlet is disposed on the housing and configured to receive a fluid. A tube bundle is disposed in the housing and configured to evaporate the fluid to provide a vapor stream arranged to exit through an outlet on the housing. A flow balancer is provided between the tube bundle and the outlet on the housing and is configured to balance refrigerant quality in the evaporator by controlling the vapor stream.

In some embodiments, an HVACR system can include an evaporator arranged to evaporate a fluid to a vapor stream. The evaporator includes a housing having a first end longitudinally opposing a second end. An inlet is disposed on the housing and configured to receive a fluid. A tube bundle is disposed in the housing and configured to evaporate the fluid to provide a vapor stream arranged to exit through an outlet on the housing. A flow balancer is provided between the tube bundle and the outlet on the housing and is configured to balance refrigerant quality in the evaporator by controlling the vapor stream.

In some embodiments, a method of operating an evaporator is disclosed. The method includes receiving a fluid from an inlet disposed on the housing having a first end longitudinally opposing a second end; evaporating the fluid with a tube bundle disposed in the housing, providing a vapor stream of the fluid; balancing refrigerant quality in the evaporator by controlling the vapor stream; and exiting the vapor stream through the outlet.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
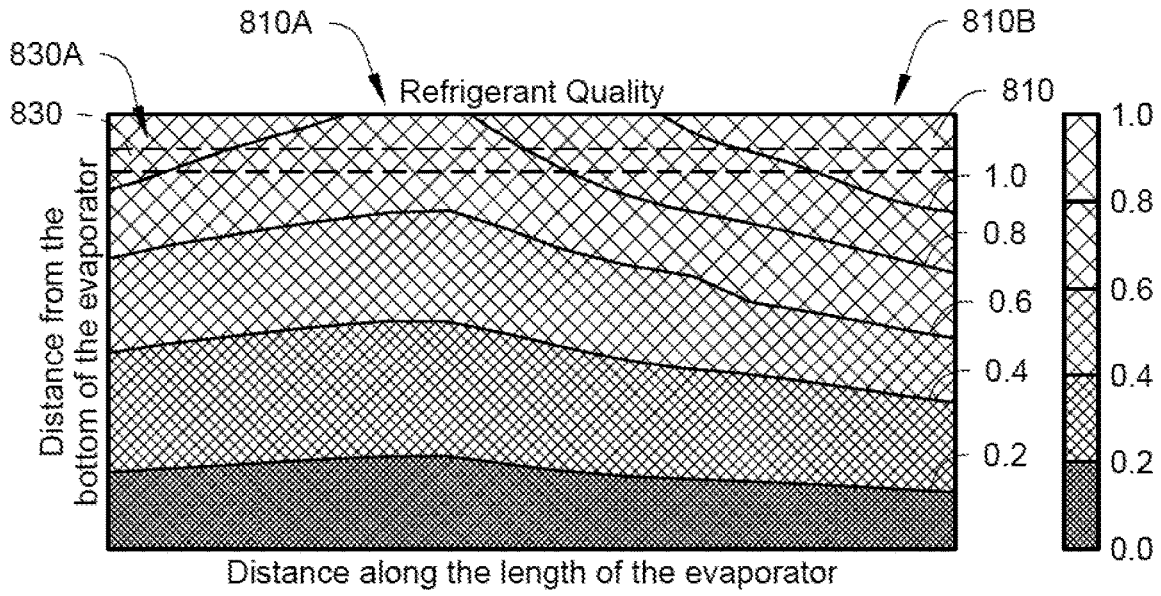
FIG. 1 shows a graphical representation of refrigerant quality in an evaporator.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Embodiments described herein are directed to heat exchangers, and preferably, an evaporator, and HVACR systems that include the evaporator, in which the evaporator includes a flow balancer to manage refrigerant charge in the evaporator. Refrigerant charge or working fluid charge can be the amount of fluid disposed in the housing or portions thereof in a segment of the housing of the evaporator at a given time, at a steady state, and or during operating of the evaporator. In some embodiments, the evaporator can be a flooded evaporator, in which the flooded evaporator receives the refrigerant from the bottom of the flooded evaporator to cover at least a portion of the tube bundle with the refrigerant.

An HVACR system can include a heat transfer circuit configured to heat or cool a process fluid (e.g., air, water and/or glycol, or the like). The heat transfer circuit includes an evaporator to evaporate a working fluid (e.g., a refrigerant) in a liquid form or a mixture of liquid and vapor form into a vapor stream. For example, in a cooling mode, the evaporator can be configured to have the working fluid absorb thermal energy from the process fluid to cool the process fluid. In some embodiments, the cooled process fluid can exchange thermal energy with indoor air to condition the indoor air.

The evaporator can include a housing, a tube bundle, an inlet, and an outlet. The inlet receives the working fluid, and the vapor stream formed from the working fluid can exit the evaporator at the outlet. The process fluid can flow through the tube bundle from a first end to a longitudinally opposing second end of the housing to exchange thermal energy with the working fluid, evaporating the working fluid to provide the vapor stream.

The working fluid is a liquid or a mixture of liquid and vapor and can accumulate in a lower portion of the evaporator, e.g., covering at least a portion of the tube bundle. The working fluid can accumulate longitudinally along the housing and be evaporated into the vapor stream.

The tube bundle extends longitudinally in the lower portion of the housing to provide the thermal energy to evaporate the working fluid. The working fluid absorbs thermal energy from the process fluid which releases thermal energy, e.g., by lowering its temperature, while flowing through the tube bundle. In an embodiment, the tube bundle has a single-path in the housing. The temperature of the process fluid can be decreasing along the longitudinal direction of the housing from the entrance to the exit of the tube bundle. Decreasing temperature can cause lower temperature differentials between the working fluid and the process fluid along the longitudinal direction inside the housing and reduce the rates of evaporation in longitudinal segments of the housing.

It is appreciated that vapor velocities in a segment can be proportional to evaporation rates. Additionally, higher vapor velocities can more effectively lift liquid droplets than that in other segments. The more effective droplet elevation can draw more refrigerant toward the high evaporation segments. In the prior evaporators, the vapor velocities can be so effective in lifting the liquid droplets such that, in the high evaporation segments, more liquid refrigerant can be available than the amount that can be evaporated by the segment of the tube bundle, which induces liquid refrigerant to leave the tube bundle, the liquid refrigerant reduces the overall efficiency of the refrigeration cycle. Further, the segment(s) having high evaporator rates can have a higher refrigerant charge than that of other segments (e.g., segment(s) with lower evaporation rates) and create an imbalanced refrigerant charge among the segments of the prior evaporators. It is appreciated that the refrigerant stream's ability to lift liquid droplets and/or a mixture liquid and vapor refrigerant can be referred to as the effectiveness of droplets elevation.

In order to control or balance the refrigerant quality in the evaporator, embodiments of an evaporator are disclosed. In some embodiments, the evaporator can include a flow balancer disposed therein. The flow balancer can balance the refrigerant quality by inducing a pressure drop over the longitudinal segment(s) with larger temperature differential (dT) (i.e., larger dT segment(s)). In some embodiments, the larger dT segment may correlate or overlap with segments with higher vapor flow rates.

The pressure drop induced by the flow balancer can control the pressure available to lift liquid refrigerant (e.g., liquid droplets) in the larger dT segment(s) to manage the droplet elevation and/or the refrigerant charge in the larger dT segment(s). It is appreciated that managing the refrigerant charge in the larger dT segment(s) can allow more refrigerant to flow to others segments, balancing the refrigerant charges among the segments of the evaporator housing.

A balanced charge can help provide proper wetting of the tube bundles by the working fluid, e.g., in the segment(s) having lower temperature differentials. Generally, a wetted tube has a higher rate of heat transfer than a dried or insufficiently wetted tube. Accordingly, increasing the portion of sufficiently wetted tubes in the tube bundle (e.g., provide proper wetting in some low dT segments of the housing) can increase the rate of heat transfer of the tube bundle as a whole and increase the heat transfer efficiency of the evaporator, compared to prior evaporators with imbalanced refrigerant charge. In some embodiments, it is appreciated that the efficiency gained from fully wetting, or properly wetting, of the tube bundle can more than offset the pressure drop induced by the flow balancer.

A flow balancer can guide a direction of the flow of the vapor stream in certain segments of the evaporator to align the distribution of the vapor stream. For example, the flow balancer can align the distribution by changing, guiding, and/or adjusting the flow direction of at least a portion of the vapor stream. The alignment can include aligning at least a portion of the vapor stream axially toward the refrigerant outlet of the housing such that the vapor flow can be more uniformly distributed, for example, across the refrigerant outlet of the housing of the evaporator. The alignment can be arranged to occur at a location near, adjacent to, or above a demister or mist eliminator. A more uniformly distributed vapor stream in the evaporator (e.g., uniform flow of vapor stream across the outlet 240 of FIG. 14, for example, having the same vapor speed) can result in a more uniformly distributed vapor stream provided to the downstream equipment, increasing the efficiency of the downstream equipment thereby increasing the overall efficiency of the HVACR system. In some embodiments, the downstream equipment can be a compressor (e.g., compressor 110 of FIG. 9). In some embodiments, more uniformly distributed vapor stream can include reducing or eliminate flow pinches. The cross section can, for example, be an inlet of a compressor, an outlet (e.g., 240 of FIG. 14) of an evaporator, within the conduits between the compressor and the evaporator, or the like. It is appreciated that the uniformity can be compared to that of prior evaporators (e.g., without a flow balancer) under the same operating condition.

Further, by balancing the refrigerant charge, the droplet elevation of larger dT segments of a prior evaporator can be higher than that of an embodiment of the evaporator disclosed herein with the same total refrigerant charge. FIGS. 1-8 are fluid dynamic charts for an evaporator without a flow balancer (e.g., a prior evaporator). The prior evaporator characterized by FIGS. 1-8 can be an evaporator similar to the evaporator 200 of FIG. 14 without having the flow balancer 250. As shown in FIGS. 1-8, the x-axis is the longitudinal distance from an end of to the prior evaporator. Comparing to exemplary embodiments of the evaporators, the left end of the x-axis can correspond to the first end 211 and the right end of the x-axis can correspond to the second end 212 as shown, for example, in FIG. 14.

FIG. 1 shows a graphical representation of refrigerant quality in an evaporator. For example, FIG. 1 can be the refrigerant quality in a lower portion of an interior of a housing of an evaporator. The evaporator, of which the refrigerant quality is shown in FIG. 1, can be a prior evaporator similar to the evaporator 200 of FIG. 14 with the flow balancer 250 removed. In FIG. 1, 830 can represent the location of a tube of a tube bundle of the evaporator of which the refrigerant quality is shown in FIG. 1. The tube can correspond to the location of an upper most tube of the tube bundle of the evaporator.

The y-axis can be a distance from the bottom of the interior of the evaporator at a central plane disposed longitudinally and/or vertically within the housing of the evaporator. The numbers on the lines indicate the refrigerant quality at the corresponding location in the housing. For example, the line with 0.2 indicates a percentage vapor to be 20% at the locations of the housing of the evaporator corresponding to the line with 0.2. The line with the number 1.0 indicates that the working fluid contains 100% or nearly 100% vapor at the locations in the housing corresponding to the line with 1.0.

A process fluid (e.g., water) can flow through an inside of the tubes of a tube bundle to exchange thermal energy with the working fluid (e.g., a refrigerant). As shown in FIG. 1, water can enter from the left and exit to the right relative to the figure. The temperature of the process fluid can be reducing while flowing through the tube bundle and resulting in reducing dT between the process fluid to working fluid (e.g., between water and the refrigerant). Higher dT can correlate with evaporation rates that are initially high enough to boil off most of the available working fluid, and have a refrigerant quality at or near 1 at the exit of the tube bundle. The refrigerant exiting the tube bundle can be the refrigerant reaching a location in the evaporator immediately above the upper most tube in the tube bundle, for example, at 830A. The liquid phase refrigerant may flow upward to exit the tube bundle due to the vapor phase refrigerant carrying the liquid phase refrigerant (e.g., liquid droplets, a mixture of liquid and vapor, or the like) upward.

At least in part due to the large temperature differential, e.g., at location 810A, liquid droplet elevation can be highly effective while the evaporation rate has decreased. This causes a large portion of the liquid working fluid to be lifted and a large amount of liquid working fluid may exit the tube bundle. The location 810A can be about 20% along the length of the evaporator from the left end where the water enters.

Additionally, as illustrated in FIG. 1, the location 810 can have a local refrigerant quality of 1.0. In this segment reduced evaporation rates result in insufficient vapor velocity to lift liquid working fluid to the upper tubes of the tube bundle for proper wetting. Accordingly, segments of the tubes in the tube bundle in the area 810 can be in the vapor stream and having poor rate of heat transfer.

According to an embodiment, a flow balancer (e.g. 250 of FIG. 12) can be configured to selectively induce a pressure drop to control the pressure along certain segments of the tube bundle, e.g., at 810A. The amount of pressure induced by the flow balancer can be proportional to the vapor velocities such that the induced pressure drop is larger at 810A but a smaller at 810B, which balance the pressure, the refrigerant charge, and/or the bundle exit quality (e.g., refrigerant quality at the location where the refrigerant exiting the tube bundle) among segments of the evaporator. It is appreciated that, comparing to the prior evaporators with the same refrigerant charge, the exemplary example of evaporator disclosed herein can include a flow balancer such that the bundle exit quality in the segment of housing at 810A is higher and the exit quality at 810B is lower (liquid dense). By equalizing or balancing the bundle exit quality (e.g., between 810A and 810B), the tubes in the tube bundles at the segment of the housing at 810B can be properly, or fully, wetted and exchange thermal energy at a higher rate than if the tubes were dry or improperly wetted.

It is appreciated that the tube(s) can be wetted from being submerged in the liquid stream of the working fluid, for example in the area lower than the line 0.2. With tubes located in the location with higher refrigerant quality (e.g., 0.6, 0.8, or the like), the working fluid can be a mixture of vapor and fluid or in which the vapor can carry droplets of the working fluid to flow around the tube bundle and cause the tube bundle to exchange thermal energy with liquid working fluid.

With the charge of working fluid in the housing being equalized or balanced, low qualities persist higher in region 810B than in prior evaporators, reducing the portion of the tube bundle exposed to the vapor stream. It is appreciated that it is not required to raise the liquid level (e.g., at 810B) so much as to submerge the tube bundle entirely into the liquid stream. A sufficiently lowered refrigerant quality having a higher percentage of liquid contacting the tube bundle can improve the overall heat transfer and improve the efficiency of the evaporator.

Figure 2:
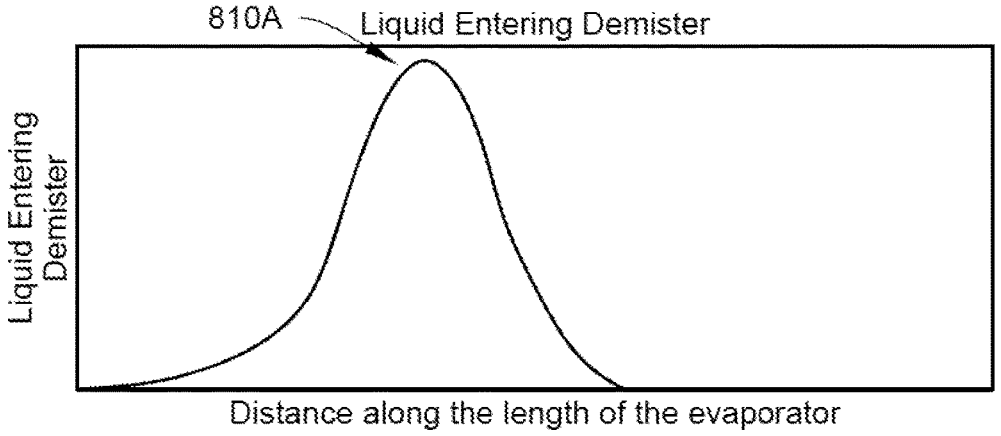
FIG. 2 shows amounts of liquid entering a demister of an evaporator.

Similar to the liquid carryover of the working fluid seen in FIG. 1, FIG. 2 shows the amounts of liquid entering a demister of a prior evaporator (e.g., an evaporator without the flow balancer but with the same refrigerant charge). As shown in FIG. 2, a large amount of entrained droplets enters into the demister at 810A. It is appreciated that the location 810A can be the same location 810A with highly effective droplet elevation but more moderate rates of evaporation (e.g., compared to that at 830A as shown in FIG. 1). Highly effective elevation and moderate evaporation can correlate with more droplets carried in the vapor stream of the working fluid into the demister.

The working fluid or refrigerant outlet of the evaporator can often be disposed at or near the location 810A above the demister, which can further reduce the vapor pressure at this location, e.g., due to compressor suction. Lower vapor pressure can correlate with lower saturation temperature, more effective droplet elevation, and/or even more rapid evaporation. The entrained droplets can be created by a large volume of refrigerant bubbles rapidly rising in the liquid stream, and further drawing charge of working fluid to the segment and away from other segments of the evaporator housing.

Figure 3:
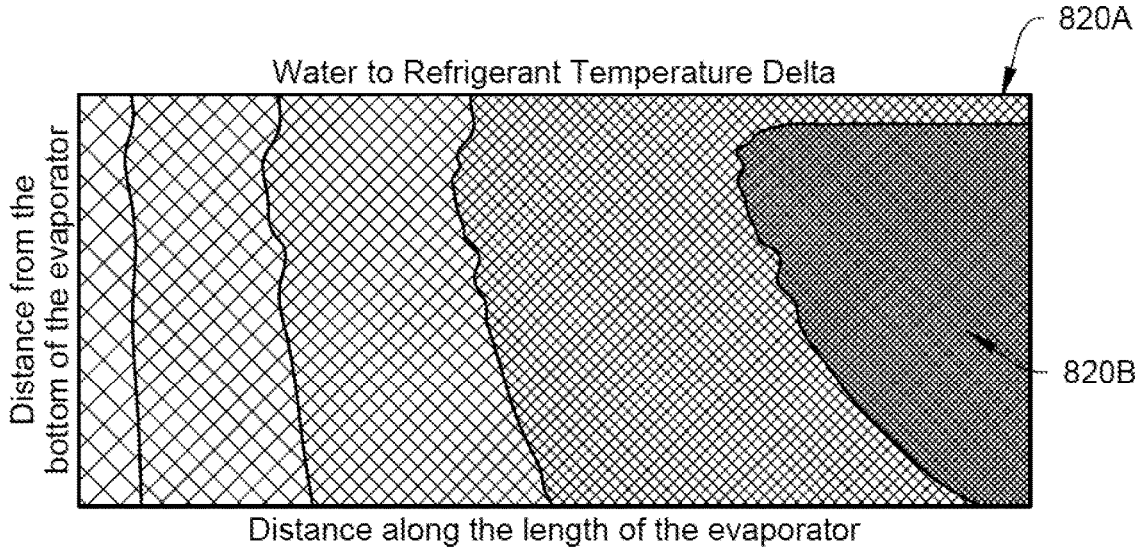
FIG. 3 shows temperature differentials in an evaporator.

FIG. 3 shows the temperature differentials in an evaporator. The y-axis can be the same as the y-axis of FIG. 1. The temperature differential can be the temperature difference between the working fluid and the process fluid. In the example shown in FIG. 3, the process fluid is provided from the left and exited from the right. Accordingly, the left has a largest temperature differential, gradually decreasing toward the right.

The process fluid (e.g., water) can be arranged to be cooled by the working fluid and to heat/evaporate the working fluid (e.g., a refrigerant). It is appreciated that, at the top right corner 820A, the process fluid temperature does not change, indicating that if the liquid working fluid were present, the process fluid could potentially be provided to increase the rate of thermal exchange. It is appreciated that 820A and 820B can be the location corresponding to the location under 810B as shown in FIG. 1. The location 820A can correspond to the location 810 of FIG. 1.

It is appreciated that the high droplet elevation at location 810A as shown in FIGS. 1-3 may be a result of a large dT and/or the high rates of boiling or evaporation near the entering end of the process fluid (e.g., water).

Figure 4:
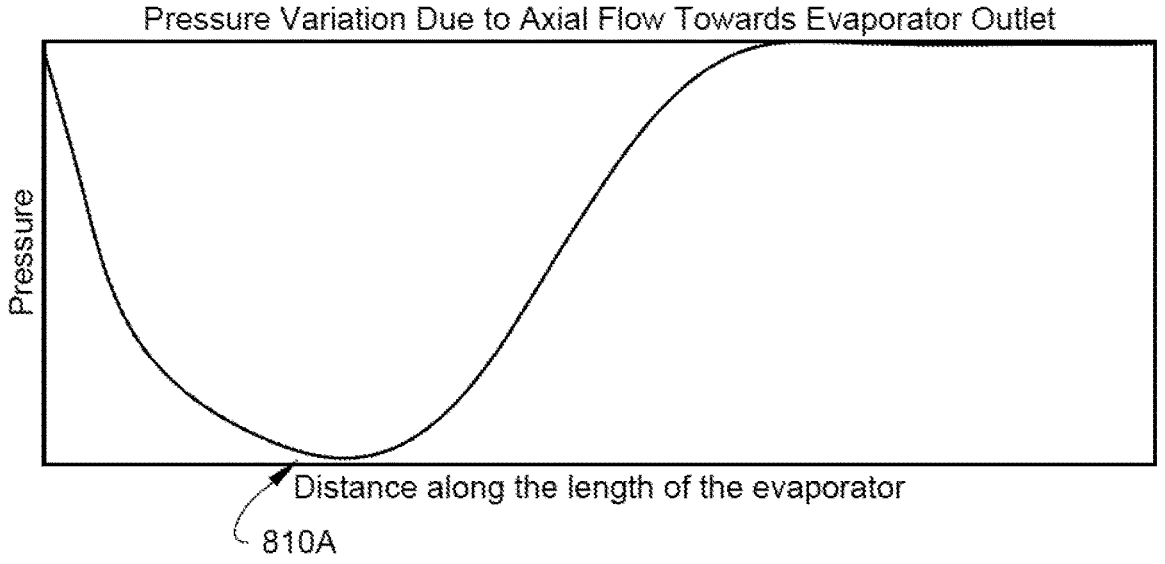
FIG. 4 shows a pressure variation due to axial flow toward the outlet of an evaporator.

FIG. 4 shows a pressure variation due to axial flow toward the outlet of the evaporator. The evaporator can be a prior evaporator without the flow balancer but with the same refrigerant charge. As shown in FIG. 4, the larger magnitude of pressure variance may occur at or near a location 810A. Axial flow can be the flow direction along the longitudinal direction of the evaporator. In some examples, 810A can be in a longitudinal location directly below the refrigerant outlet of the evaporator.

Generally, pressure variance from axial flow can be caused by the mass flow exiting the tube bundle and/or the location of the refrigerant outlet. A larger pressure variance allows low quality (i.e., liquid dense) flow to climb higher in the tube bundle such that more entrained droplets are carried by the vapor stream. Pressures just above far segments of the tube bundle can be higher than at 810A suppressing low quality flow in these segments.

According to some embodiments, an evaporator that includes a flow balancer can add an additional pressure loss mechanism which can be selectively applied to suppress low quality refrigerant flow. This can reduce the amount of entrained droplets in the vapor stream at the refrigerant outlet of the evaporator (e.g., compared to a prior evaporator with the same refrigerant charge). The pressure loss mechanism can be further configured to beneficially align the flow of the vapor stream to reduce frictional loss as the vapor exits the housing of the evaporator, for example, via the refrigerant outlet.

In order to help understand pressure variances along the evaporator, FIGS. 5-8 are provided to illustrate the pressure drop for the working fluid in an evaporator. For example, the total pressure drop across the tube bundle can include the accumulative effect of frictional, momentum, and static losses. The y-axis of FIGS. 5-8 shows a distance from the bottom of the evaporator.

Figure 5:
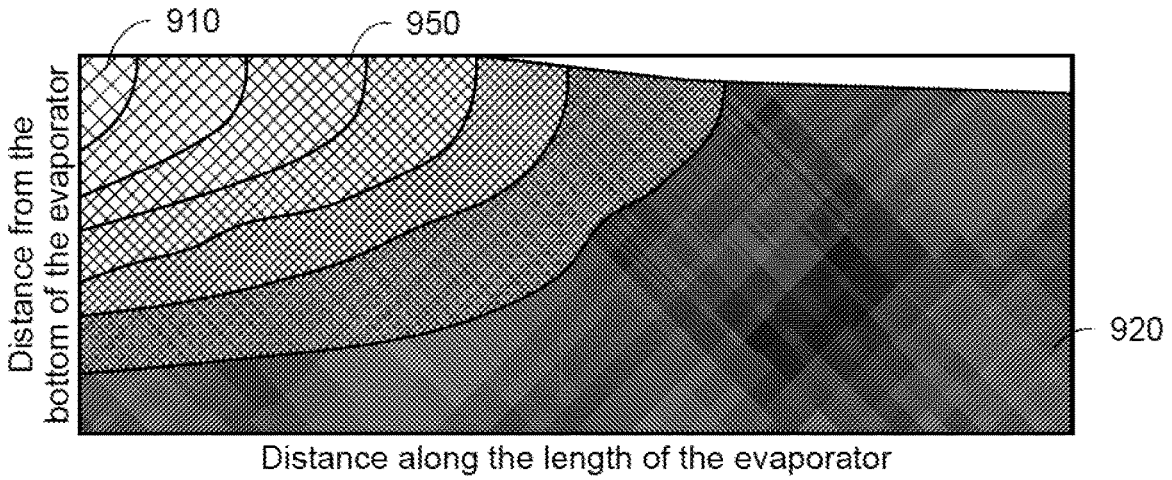
FIG. 5 illustrates the pressure drop due to frictional losses in an evaporator.

FIG. 5 illustrates the pressure drop due to frictional losses that include the pressure drop due to, for example, the working fluid contacting the tube bundle creating resistance in the flow of the vapor and liquid stream of the working fluid. As shown in FIG. 5, the amount of pressure drop due to frictional loss is higher at the top right corner 910 and lower on the right side 920, indicating higher mass flow rates due to the more rapid evaporation on the left side than that on the right side of the evaporator.

Figure 6:
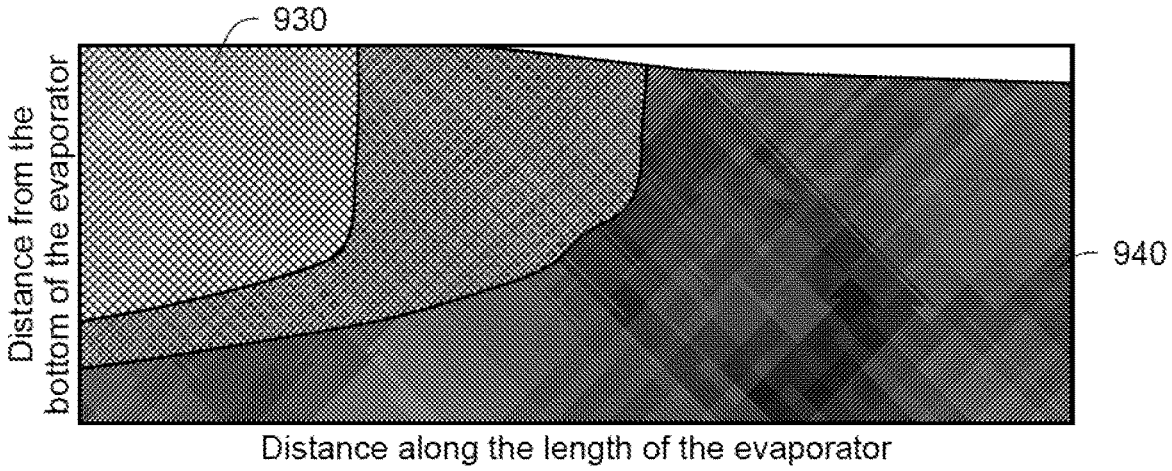
FIG. 6 illustrates the pressure drop due to momentum losses in an evaporator.

FIG. 6 illustrates the pressure drop due to momentum losses that can includes the pressure drop due to the evaporation, converting from liquid to vapor and accelerating the flow as it expands. As shown in the FIG. 6, the pressure drop due to momentum loss is higher in the left side 930 than that of the right side 940, corresponding to the pattern of a decreasing rate of evaporation from the left to the right of the housing of the evaporator. It is appreciated that the magnitude of pressure drop is pattern matched such that the amount of pressure drop due to momentum loss at 930 is similar to that of the frictional loss at 950 (shown in FIG. 5); and the amount of pressure drop due to momentum loss at 940 is similar to that of the frictional loss at 950 (shown in FIG. 5).

Figure 7:
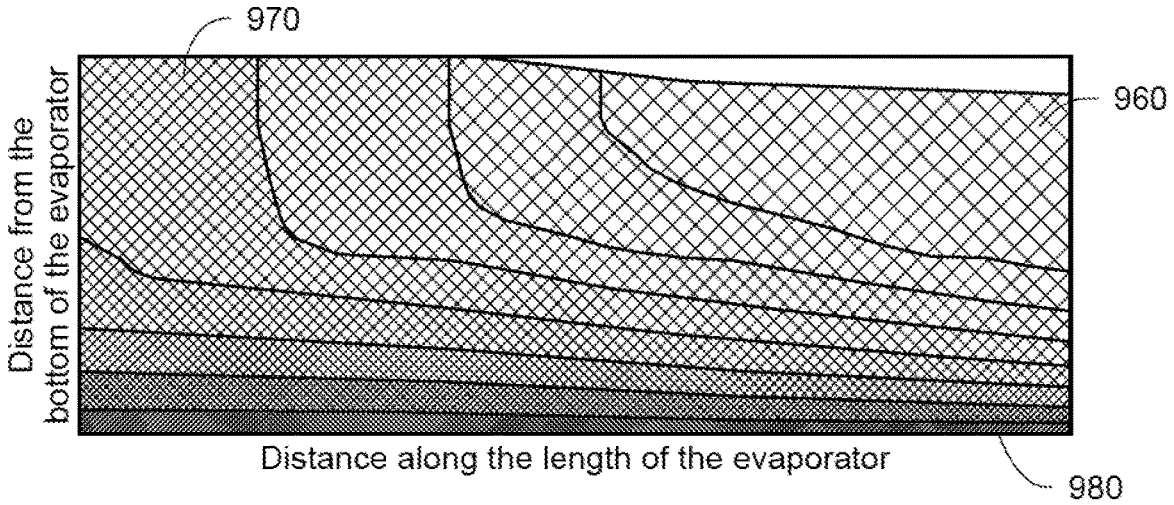
FIG. 7 illustrates the static pressure drop in an evaporator.

FIG. 7 illustrates the static pressure variation in the evaporator. The static pressure represents the energy needed to elevate the refrigerant upwards from the inlet at the bottom of the evaporator to the outlet at the top of the evaporator. As shown in the FIG. 7, the pressure variation due to elevation is higher in the top right corner 960, lower in the top left corner 970, and the lowest on the bottom 980. It is appreciated that the magnitude of pressure drop is pattern matched such that the amount of pressure variation due to static pressure at 960 is similar to that at 910 of FIG. 5, 970 is similar to 950 of FIGS. 5, and 980 is similar to 920 of FIG. 5.

Figure 8:
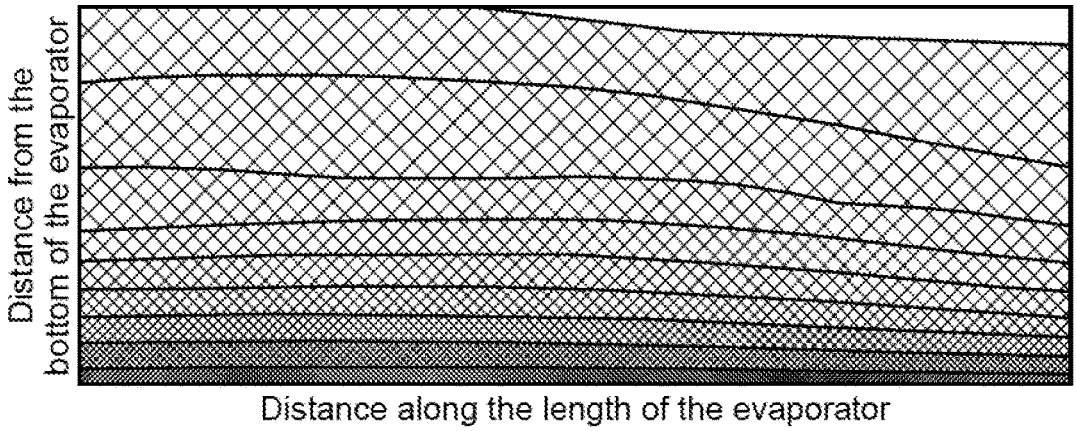
FIG. 8 illustrates the total pressure drop in the evaporator, combining FIGS. 5-7.

FIG. 8 illustrate the total pressure drop in the evaporator, combining FIGS. 5-7. As shown in FIGS. 5-8, the amount of vapor generated at a given axial position is largely a function of the temperature differential (e.g., between the water and the refrigerant), and the pressure losses associated with friction and momentum losses are largely driven by this temperature differential. To maintain the near uniformity of pressure at the tube bundle exit, the static pressure differential at an axial position varies. At some axial positions (e.g., 810A), the resulting static pressure differential provides the tube bundle with too much low quality (liquid dense) working fluid. Accordingly, introducing an additional pressure drop can reduce the static pressure component resulting in higher working fluid quality (less liquid) at the tube bundle exit. As such, the working fluid quality and/or the exit quality of the working fluid can be controlled in the evaporator. The exit quality can be the refrigerant quality of the refrigerant at a location immediately above the upper most tube in the tube bundle (e.g., at 830A of FIG. 1). For example, the exit quality level on the left side, or the larger dT segments, of the evaporator can be raised. The excess working fluid mass from the left side of the evaporator migrates to the right side of the evaporator. Low qualities on the right end (e.g., lower dT segments of the evaporator) persist higher up in the tube bundle, these tubes thus receive sufficient amounts of low-quality working fluid to maintain high rates of evaporative heat transfer, thus increasing the overall efficiency of the evaporator.

According to some embodiments, in order to control or balance the quality of refrigerant in the evaporator, a flow balancer can be used in an evaporator, for example, for the HVACR system. The flow balancer can induce a pressure drop over the segment(s) with excessively low bundle exit qualities (e.g., larger dT segments) to suppress refrigerant mass in these segments. The pressure drop required to shift the working fluid is generally not substantial enough to negatively impact heat transfer rates in the larger dT segments of the evaporator. Accordingly, the working fluid can migrate to other segments of the housing, thus, balancing and/or optimizing the charge of refrigerant disposed in the segments of the evaporator housing, as further discussed below.

Figure 9:
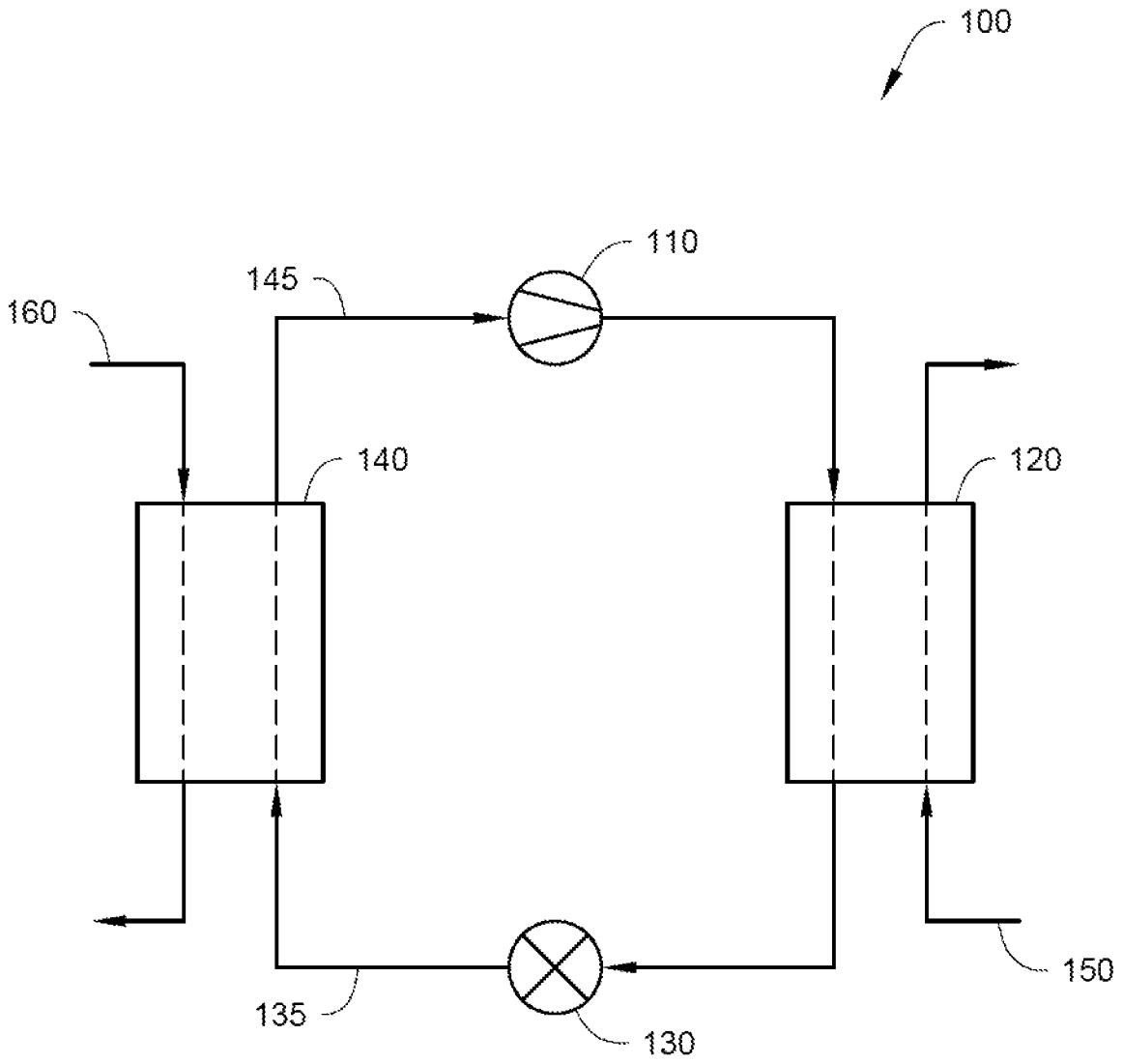
FIG. 9 is a schematic diagram of a heat transfer circuit 100 of an HVACR system, according to an embodiment.

FIG. 9 is a schematic diagram of a heat transfer circuit 100 of an HVACR system, according to an embodiment. The heat transfer circuit 100 includes components that are fluidly connected to each other, including a compressor 110, a condenser 120, an expander 130, an evaporator 140, etc. In other embodiments, additional components can include an economizer heat exchanger, one or more flow control devices, a receiver tank, a dryer, a suction-liquid heat exchanger, or the like.

The heat transfer circuit 100 can be configured as a cooling system (e.g., a water chiller, a fluid chiller of an HVACR, an air conditioning system, or the like) that can be operated in a cooling mode. The heat transfer circuit 100 can be configured to operate as a heat pump system that can run in a cooling mode and a heating mode.

The heat transfer circuit 100 applies known principles of a vapor-compression refrigeration cycle. The heat transfer circuit 100 can be configured to heat or cool a process fluid such as water, glycol, gas, air, or the like. In an embodiment, the heat transfer circuit 100 may represent a chiller system that cools any process fluids such as water, glycol, gas, air, or the like. In an embodiment, the heat transfer circuit 100 may represent an air conditioner and/or a heat pump that cools and/or heats a process fluid such as air, water, or the like.

During the operation of the heat transfer circuit 100, a vapor stream of a working fluid at a relatively low pressure of (e.g., refrigerant, refrigerant mixture, or the like) can flow into the compressor 110 from the evaporator 140. The vapor stream can be the working fluid in a vapor form or predominately vapor form. The compressor 110 compresses the vapor stream into a high pressure state having a relatively high pressure, which can also increase the temperature of the vapor stream to have a relatively high temperature. After being compressed, the vapor stream flows from the compressor 110 to the condenser 120. In addition to the vapor stream of the working fluid flowing through the condenser 120, a first process fluid 150 (e.g., external air, external water, chiller water, heat transfer fluid, or the like) also separately flows through the condenser 120. The first process fluid 150 exchanges thermal energy with the working fluid as the first process fluid 150 flows through the condenser 120, cooling the working fluid as it flows through the condenser 120. The vapor stream of the working fluid condenses to a liquid form or predominately liquid form, providing a liquid stream. The liquid stream then flows into the expander 130.

The expander 130 allows the working fluid to expand, lowering the pressure of the working fluid. In an embodiment, the expander 130 can be any expansion devices such as an expansion valve, expansion plate, expansion vessel, orifice, or the like. It should be appreciated that the expander may be any type of expander used in the field of expanding a working fluid to cause the working fluid to decrease in pressure and/or temperature.

The liquid stream of relatively lower pressure working fluid then flows into the evaporator 140, for example, via a conduit 135. A second process fluid 160 (e.g., external air, external water, chiller water, heat transfer fluid, or the like) also flows through the evaporator 140. The working fluid exchanges thermal energy with the second process fluid 160 as it flows through the evaporator 140, cooling the second process fluid 160. As the working fluid exchanges thermal energy (e.g., absorb heat), the working fluid evaporates to a vapor, or a predominately vapor form, providing the vapor stream. The vapor stream of the working fluid then returns to the compressor 110 from the evaporator 140, for example, via a conduit 145.

Figure 10:
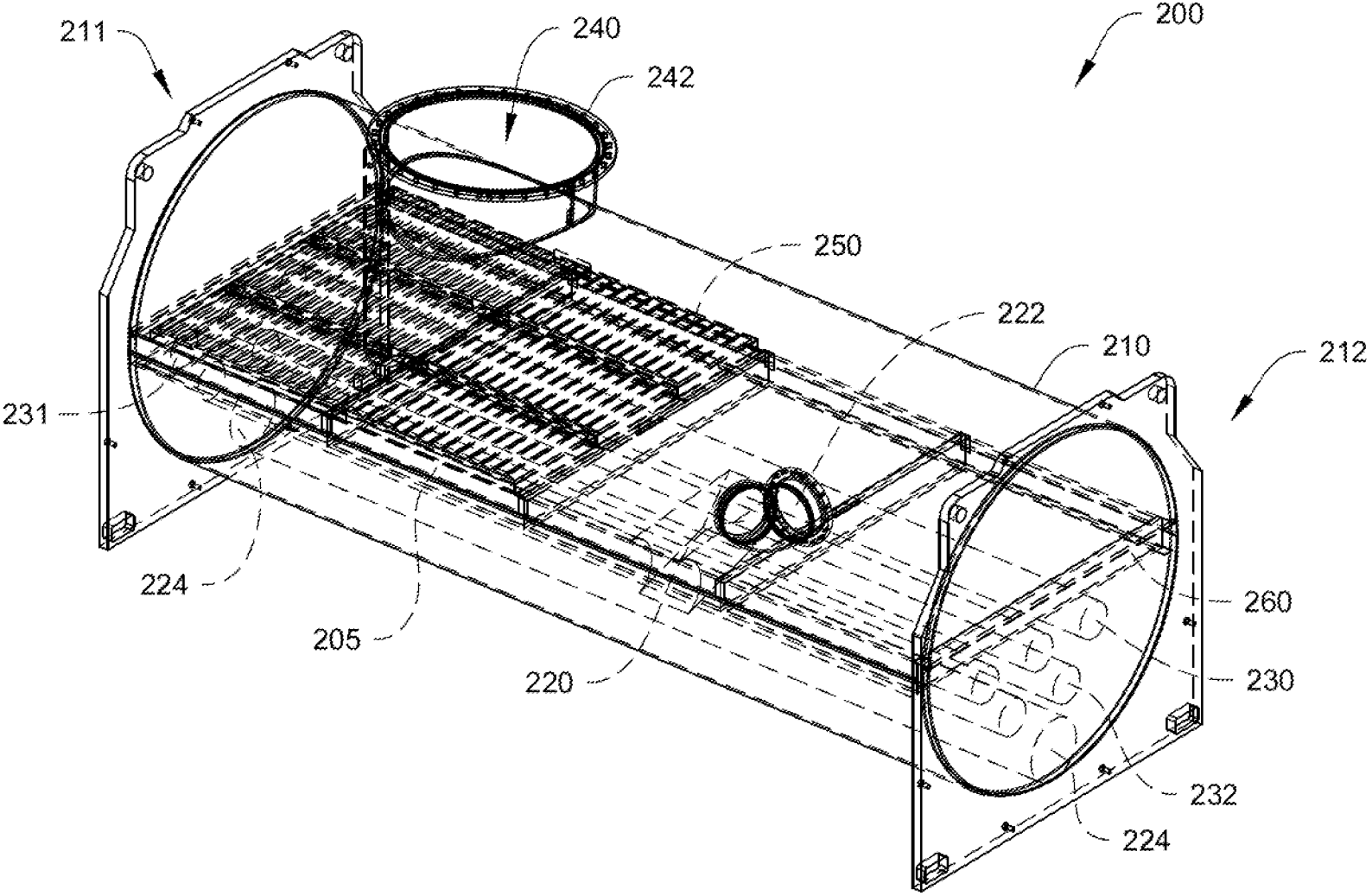
FIG. 10 is perspective view of an evaporator, according to an embodiment.

FIG. 10 is perspective view of an evaporator 200, according to an embodiment. In some embodiments, the evaporator 200 can be the evaporator 140 as shown in FIG. 9.

As illustrated in FIG. 10, the evaporator 200 includes a housing 210 having a first end 211 longitudinally opposing a second end 212. An inlet 220 is disposed on the housing 100 and configured to receive a first fluid (e.g., working fluid, refrigerant, etc.). The first fluid can be a working fluid. A tube bundle 230 is disposed in the housing 210 and configured to evaporate the working fluid, providing a vapor stream arranged to exit through an outlet 240 on the housing. A flow balancer 250 is disposed in the housing 210 between the tube bundle 230 and the outlet 240 on the housing, the flow balancer being configured to provide a pressure drop in the vapor stream at the first end 211 of the housing 210.

The housing 210 can be a shell having an interior 205, containing components such as the tube bundle 230, the flow balancer 250, or the like. The housing 210 can have an elongated body with the first end 211 and the second end 212 opposing each other in the longitudinal direction of the elongated body.

The inlet 220 is disposed on the housing 210. The inlet 220 can be an opening on the housing 210 to receive the working fluid. In some embodiments, a conduit 222 can fluidly connect to the interior 205 of the housing 210 via the inlet 220 to provide the working fluid, for example, from an expander (e.g., the expander 130 of FIG. 9). In some embodiments, the conduit 222 connected to the inlet 220 can be the conduit 135 as shown in FIG. 9, or a portion of the conduit 135.

In some embodiments, the working fluid received in the evaporator 200 can be a liquid stream of a refrigerant in liquid form or predominantly liquid form. In some embodiments, the liquid stream can include a percentage of weight, volume, or the like of the refrigerant vapor in the liquid stream, for example, as bubbles flowing with in the liquid stream. For example, the liquid stream with no (e.g., 0% or nearly 0%) vapor can have a refrigerant quality of 0; and the liquid stream with no or nearly no liquid can have a refrigerant quality of 1.

The inlet 220 can optionally connect to a distributor 224 that extends in the longitudinal direction in the interior 205 of the housing 210. The distributor 224 can be one or more tube or channels to distribute the working fluid to flow in the longitudinal direction in the interior 205 of the housing 210. It is appreciated that the inlet 220 is illustrated to be located in the middle between the first end 211 and the second end 212 of the housing 210. However, the inlet 220 can be located anywhere on the housing 210 for receiving the working fluid. In some embodiments, the inlet 220 is located in a lower portion 213 (shown in FIG. 12) of the housing 210. In some embodiments, the inlet 220 can be a refrigerant inlet, a liquid stream inlet, a refrigerant liquid stream inlet, or the like.

The tube bundle 230 can include a plurality of tubes configured to receive a second fluid to evaporate the working fluid. The second fluid can be a process fluid (e.g., air, water, glycol, a mixture glycol and/or water mixture, etc.) that flow through interiors of the tubes of the tube bundle 230.

The process fluid can enter the interiors of the tubes of the tube bundles 230 from a first end of the tube 231 and exit the tube from a second end of the tube 232. In some embodiments, the first end of the tube 231 can be an inlet end and the second end of the tube 232 can be an exit end. In a cooling mode, after the process fluid being cooled by the working fluid, the process fluid can be provided to a conditioned space to directly or indirectly provide cooling in the conditioned space.

The tube bundle 230 can receive the process fluid from a process fluid supply disposed on, for example, the first end 211 and/or the second end 212 of the housing 210. The process fluid supply can include, for example, a water box (not shown) fluidly connecting a process fluid source (e.g., water source) to distribute the process fluid into the entering ends the tubes in the tube bundle 230. In some embodiments, the process fluid can enter the interior of the tubes via a tube inlet 231. In some embodiments, the tube inlet(s) 231 receiving the process fluid is disposed on the first end of the housing 210. The process fluid can exit the interior of the tubes of the tube bundle 230 via a tube outlet 232. In some embodiments, the tube outlet(s) 232 can be disposed on at the second end 212 of the housing 210.

It is appreciated that the tube bundle can have a single-path or more than one path. In the illustrated example, the tube bundle 230 has a single path including straight tubes that extend from the first end 211 to the second end 212 such that the tube inlet(s) 231 is disposed at the first end 211 and the tube outlet(s) 232 can be disposed at the second end 212 of the housing 210. In some embodiments, the tube bundle can include bent tubes or multi-pass arrangements in the ends to create one or more forward paths and one or more return paths. For example, the tubes can be bent 180 degrees at or near the second end 212 such that both the tube inlet(s) 231 and the tube outlet(s) 232 are disposed on the first end 211 of the housing 210.

The outlet 240 is disposed on the housing 210. The outlet 240 can be an opening on the housing 210 to allow the vapor stream of the working fluid to exit from the housing 210. The vapor stream can exit the housing 210 and flow to the compressor 110 via the conduit 145 as shown in FIG. 9. In some embodiments, a conduit 242 can fluidly connect to the interior 205 of the housing 210 via the outlet 240 to allow the vapor stream to exit the housing 210. In some embodiments, the conduit 242 connected to the outlet 240 can be the conduit 145 as shown in FIG. 9, or a portion of the conduit 145. In some embodiments, the outlet 240 can be a refrigerant outlet, a vapor stream outlet, a vapor stream refrigerant outlet, or the like.

In some embodiments, the vapor stream of the working fluid can be a refrigerant in vapor form or in predominantly vapor form. In some embodiments, the vapor stream can be superheated vapor stream to reduce providing, or carryover, liquid droplets to downstream equipment. For example, a compressor (e.g., 110 of FIG. 9) can be downstream from the evaporator 200, and liquid (e.g., entrained droplets) can cause mechanical damages from collisions of the droplets with compressor components spinning at a high speed and/or damages from corrosion and/or reduce efficiency of the same.

It is appreciated that the evaporator 200 can be a shell and tube evaporator, such as a flooded evaporator or a flooded-type evaporator used in a refrigeration system. In some embodiments, a working fluid can accumulate in a lower portion of the housing 210 to wet the tube bundle 230.

It is appreciated that the tube can be wetted by being submerged in liquid working fluid and/or by refrigerant vapor bringing liquid droplets to be in contact with the tubes, or a portion of the tubes, in the tube bundle. For example, the refrigerant quality can be balanced or controlled such that, at the location of the threshold (e.g., 215 discussed below), the refrigerant quality is within a preferred range. In some embodiments, the preferred range can be 0.5-0.8, 0.6-0.8, or the like. With tubes located in the location with higher refrigerant quality (e.g., 0.6, 0.8, or the like), the working fluid vapor can carry droplets of the working fluid to flow through and contact the tube bundles, causing the tube bundle to exchange thermal energy with the liquid working fluid. At or above certain refrigerant quality (e.g., 0.8 or 0.9) the flowing working fluid can contain so little liquid that the upper tubes in the tube bundle exchange little thermal energy with predominately vaporized working fluid, since vapor generally has a lower rate of heat transfer.

The flow balancer 250 can be disposed in the interior 205 of the housing 210 and in the vapor stream of the working fluid to optimize, or balance, the pressure drop of the vapor stream evaporated by the tube bundle 230 and/or the refrigerant charge in the evaporator. Optimizing or balancing the vapor stream pressure drop can include causing the vapor speed, the differential pressure, or the like, to be electively induced across the longitudinal segments of the housing 210, or the like, e.g., substantially different across the longitudinal segments. It is appreciated that the velocity vector of the vapor flow departing the flow balancer 250 may be directed to present a more uniformly distributed flow, and/or a more uniformly distributed vapor stream, to the outlet 240 of the evaporator 200. The uniform flow distribution reduces local separation and/or flow recirculation zones. Local high velocity zones and associated frictional pressure losses are thus reduced or eliminated.

The flow balancer 250 can induce a pressure drop in the vapor stream, for example by reducing an overall cross-sectional area in the flow path through the flow balancer 250, changing flow directions of the vapor stream, or the like, and/or increasing the pressure in the evaporator, especially at certain segments. The magnitude of the pressure drop created by the flow balancer 250 in a given segment can generally correspond to the vapor velocity in the corresponding segment of the housing 210, which can affect the liquid level, and/or refrigerant charge, of the refrigerant in the different segments of the housing 210. Accordingly, the flow balancer 250 can create a larger pressure drop in the segments of higher flow rate, higher liquid level, and/or more effective droplet elevation. In some embodiments, the flow balancer 250 does not remove or reduce entrained droplets from the vapor stream.

A demister 260 can be disposed in the housing 210. The demister 260 can be disposed in the vapor stream in the interior 205 of the housing 210 to remove or reduce entrained droplets from the vapor stream. In some embodiments, the demister 260 can be disposed between the liquid level and the flow balancer 250. In some embodiments, the flow balancer 250 can be disposed between the demister 260 and the outlet 240 of the housing 210.

Figure 11:
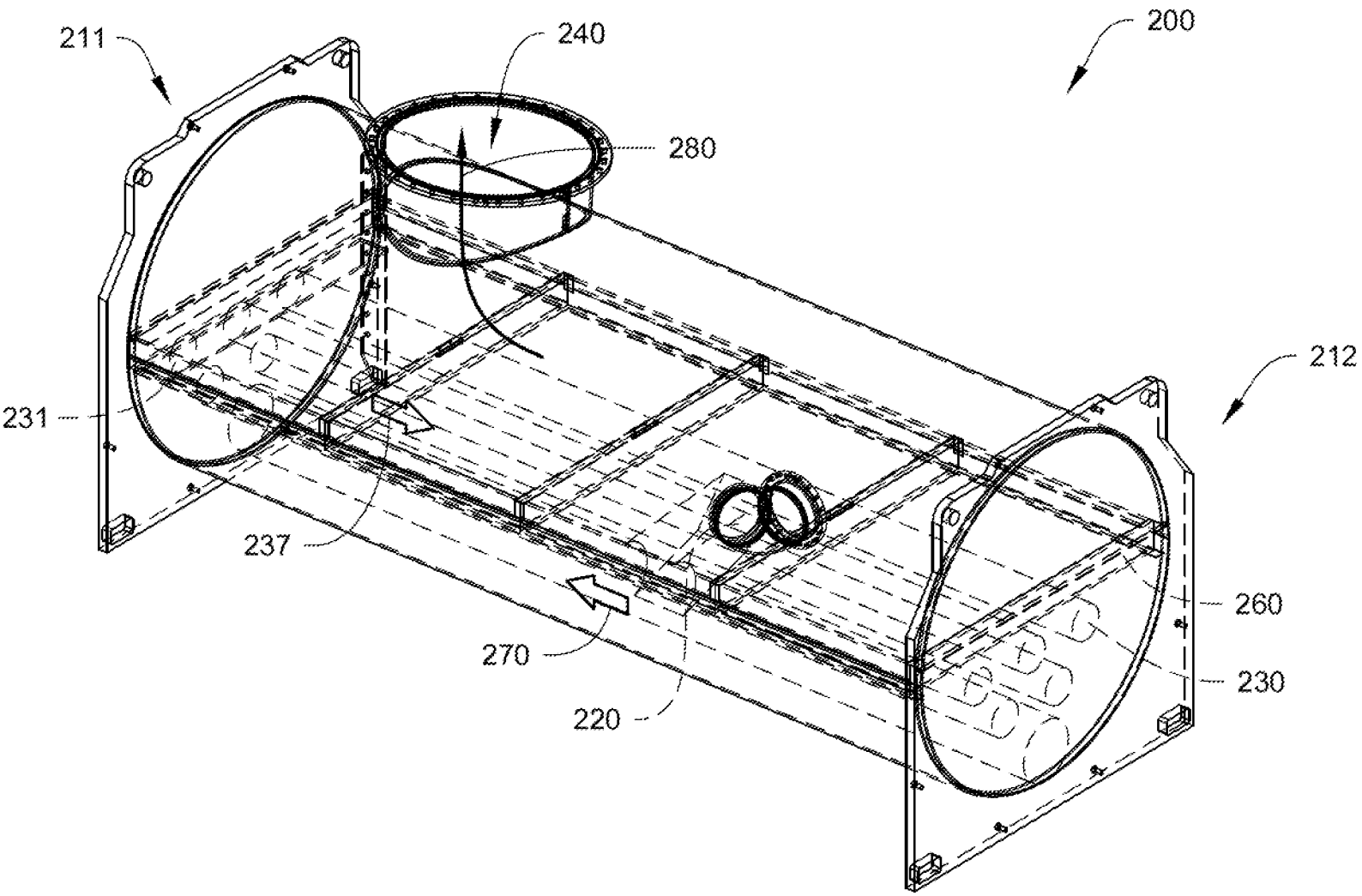
FIG. 11 is a perspective view of the evaporator, according to the embodiment of FIG. 10, with the flow balancer omitted to show the interior.

FIG. 11 is a perspective view of the evaporator 200, according to the embodiment of FIG. 10, with the flow balancer 250 omitted to show the interior 205. In some embodiments, excess liquid droplets are removed by a mist eliminator or demister. As shown is FIG. 11, the tube bundle 230 is arranged to extend from the first end 211 to the second end 212 to evaporate the liquid stream 270 received from the inlet 220. A process fluid 237 can flow inside the tubes 231 of the tube bundle 230 from the first end 211 via the tube inlets 231 toward the tube outlet 232 at the second end 212. It is appreciated that the process fluid 237 can flow in any direction to exchange thermal energy with the working fluid to evaporate the liquid stream 270. For example, the opposite direction (i.e., from the second end 212 toward the first end 211), flow in multiple paths of the same or different directions, or the like. As illustrated in FIG. 11, the demister 260 can be disposed in the housing 210 extending from the first end 211 to the second end 212. It is appreciated that the demister can be disposed anywhere in the housing 210 to remove entrained droplets from the vapor stream 280.

The demister 260 can have a porous structure to allow vapor in the vapor stream to pass through voids in the porous structure. Any liquid droplets entrained in the vapor stream can be removed by the porous structure before exiting the demister 260, e.g., due to friction and/or inducing the entrained droplets to collide with each other and/or with the porous structure and creating larger droplets that are more likely to fall out from the vapor stream.

It is appreciated that the demister 260 can be any porous structure, finned structure, filter, or the like, such as, a mesh, a stack of mesh having the same or different structures, finned plate(s), wired mesh(es), filter(s), or the like, or a combination thereof. The demister 260 can be actively heated or cooled utilizing a power source (e.g., an electric heater or a heat transfer fluid stream) to remove or reduce entrained droplets. It is further appreciated that the demister 260 is configured to induce little to no pressure drop for the vapor stream while providing a large surface area for removing droplets from the vapor stream. For example, the surface area for a demister can be 100-5000 $m^2$ per $m^3$ such that droplets in the vapor stream passing through the demister 260 can more likely collide with the surface for the demister 260 and be removed from the vapor stream. A demister is further configured to capture nearly all droplets as small as 5-10 microns. A demister typically includes large amounts of open area to allow efficient drainage and to minimize pressure losses. Pressure losses are often maintained at less than 0.01 psi but may increase to 0.03 psi under heavy liquid loads.

Figure 12:
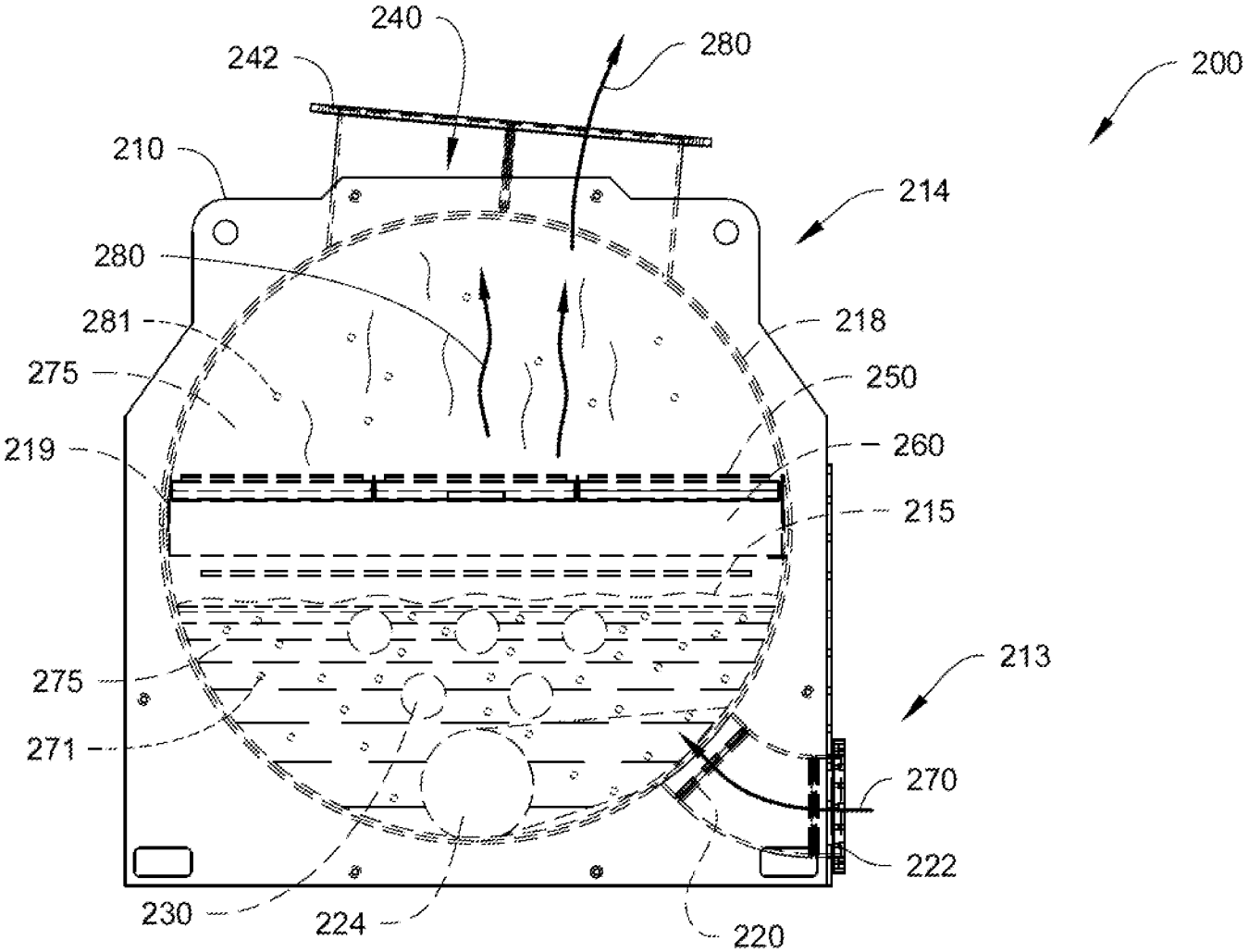
FIG. 12 is an end view of the evaporator, according to the embodiment of FIG. 10.

FIG. 12 is an end view of the evaporator 200, according to the embodiment of FIG. 10. The view of FIG. 12 can be a view from the first end 211 (shown in FIG. 10) toward a center of the housing 210. As illustrated in FIG. 12, the evaporator 200 has a lower portion 213 and an upper portion 214. The tube bundle 230 can be disposed in the lower portion 213 of the housing to evaporate a working fluid 275 from a liquid stream 270, providing a vapor stream 280. The vapor stream 280 can exit the housing 210 via the outlet 240.

The liquid stream 270 can be the working fluid (e.g., a refrigerant) in liquid form or predominately liquid form that contains a portion of vapor bubbles 271 flowing with the liquid stream. As the liquid stream 270 accumulates in the lower portion 213 of the housing 210, the tube bundle 230 can evaporate the working fluid to create more bubbles that contain pockets of vapor of the working fluid 275. At the threshold 215 between the liquid space and the vapor space, all or nearly all the liquid from working fluid 275 are evaporated into vapor. In some embodiments, the threshold 215 represents the location within the housing 210 of the minimum quality threshold. If working fluid qualities below this were to enter the mist eliminator they would overwhelm it and pass liquid working fluid out of the evaporator tube bundle. The threshold 215 may also represent where the amount of liquid refrigerant available is insufficient to support the full potential of evaporation from the tubes. It is appreciated that the working fluid evaporated into a vapor form can include a vapor stream with entrained droplets 281 that flow with the vapor stream 280. It is appreciated that tubes in a tube bundle of a flooded evaporator is generally wetted by the flowing droplets in the vapor stream, submersion, or a combination of both. Tubes disposed in an upper portion of the tube bundle 230 (i.e., upper tubes) can be wetted primarily by liquid droplets carried by flowing vapor. The droplets contact the tube and cover the outer surface of the tube so that the tube is exchanging thermal energy with a liquid film formed by the droplets. Tubes disposed in a lower portion of the tube bundle (i.e., lower tubes) can be wetted by pooled or accumulated liquid.

The flow balancer 250 can be disposed in the vapor stream 280, above the threshold 215 to induce pressure drop in the vapor stream 280 and/or in the housing 210. In an embodiment, the flow balancer 250 can be disposed above the demister 260 in the flow direction of the vapor stream 280. In the illustrated example of FIG. 12, the flow balancer 250 is located immediately above the demister 260. In some embodiments, the flow balancer 250 can be located above the threshold 215 or the demister 260, and spaced away from the threshold 215 and/or the demister 260. It is appreciated that the flow balancer 250 can be disposed anywhere in the interior 205, and/or the upper portion 214, of the housing 210 to manage the flow of the vapor stream 280.

Figure 13:
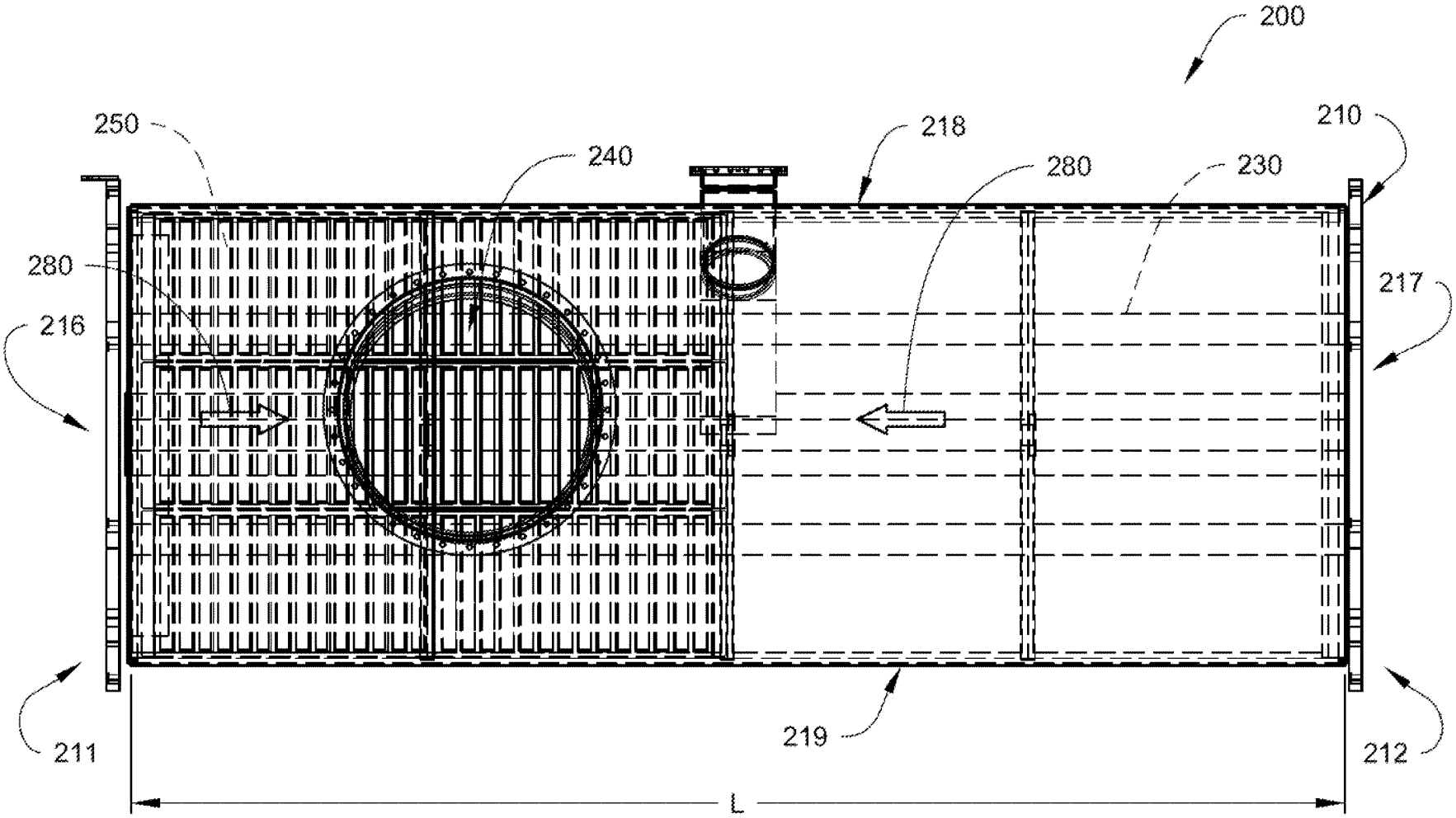
FIG. 13 is a top view of the evaporator, according to the embodiment of FIG. 10.

FIG. 13 is a top view of the evaporator 200, according to the embodiment of FIG. 10. As shown in FIG. 13, the tube bundles 230 extends in the longitudinal direction L of the housing 210 of the evaporator 200. The housing 210 can include an end panel 216, an end panel 217, a side wall 218, and a side wall 219 encasing the interior 205 of the housing 210. The side walls 218, 219 can curve above and below the interior 205 to form the elongated body of the housing 210. In some embodiments, the side walls 218, 219 and the end panels 216, 217 can form a cylindrical volume of the interior 205 of the housing 210. The end panel 216 is disposed on the first end 211 of the housing 210 and the end panel 217 is disposed on the second end 212 of the housing 210.

The flow balancer 250 can be disposed at the first end 211 of the housing above the demister 260 (not shown). The outlet 240 is disposed above the flow balancer 250. It is appreciated that the flow balancer 250 can be adjacent, connected, in contact with, or spaced away from, any or all of the end panel 216, end panel 217, side wall 218, and/or side wall 219 of the housing 210 of the evaporator 200. In some embodiments, the flow balancer 250 can be extended along the entirety of the length of the tube bundle 230 to be connected with or adjacent to all of the end panels 216, 217 and side wall 218, 219 such that forcing all or nearly all of the vapor stream 280 through the flow balancer 250. In some embodiments, the flow balancer 250 is provided along certain segments of the tube bundle 230 to control the refrigerant charge in the evaporator 200.

Figure 14:
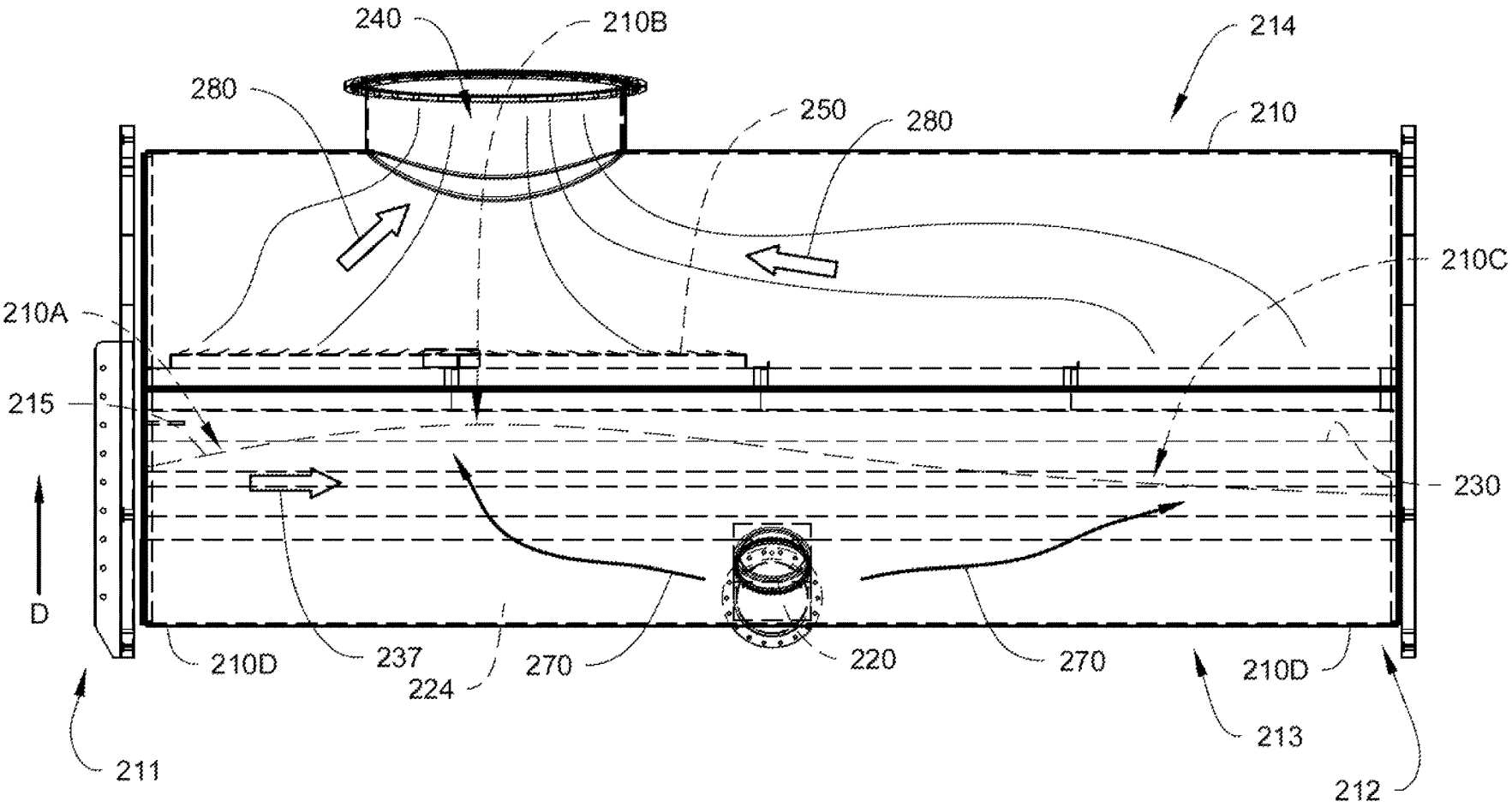
FIG. 14 is a longitudinal sectional view of the evaporator, according to the embodiment of FIG. 10.

FIG. 14 is a longitudinal sectional view of the evaporator 200, according to the embodiment of FIG. 10. As shown in FIG. 14, the liquid stream 270 of the working fluid flows into the housing 210 from the inlet 220 and evaporates to provide the vapor stream 280. The distributor 224 can be one or more tube or channels to distribute the working fluid to flow in the longitudinal direction in the interior 205 of the housing 210. The vapor stream 280 exits the housing 210 through the outlet 240. The process fluid 237 can flow from the first end 211 to the second end 212 through the interiors of the tubes of the tube bundles 230. The process fluid 237 transfers thermal energy to the working fluid to evaporate the liquid stream 270.

It is appreciated that, during the evaporating of the working fluid in the housing 210, the threshold 215 can obtain a higher level in some longitudinal segments and lower level in other longitudinal segments of the housing 210. The height of the threshold 215 can be a vertical distance, in the D direction, between a bottom 210D of the housing 210. The bottom 210D can be located on a centerline of the lower potion 213 of the housing 210. At the first end 211 of the housing 210 the threshold at the segment 210A the threshold can be lower, at the segment 210B the liquid level can be higher, and at the segment 210C the liquid level can be lower.

As shown in the illustrated example of FIG. 14, during evaporation of the working fluid, the working fluid quality at, for example, segment 210C can expose a portion of the segments of the tube bundle 230 to qualities which are too high to fully support evaporation. Accordingly, the portion of the segment of the tube bundle 230 at segment 210C can be in contact with the vapor stream 280. While the liquid stream 270 evaporates, the threshold 215 can rise at segment 210B, this reduces the liquid available in other segments (e.g., segments 210A, 210C). The vapor stream 280 can flow through the flow balancer 250 that provide a pressure drop in the vapor stream 280, so that the threshold 215 around segment 210B is pressed downward.

The flow balancer 250 can be a device that is configured to balance refrigerant quality by restraining, aligning, and/or changing a direction of a flow path of the vapor stream 280 to create a pressure drop or increased pressure at a certain segment of the tube bundle. The magnitude of pressure drop can be proportional or correlated with the vapor flow speed or flow rate of the vapor stream, such that the segment with higher vapor flow can correlated with higher pressure drop created by the flow balancer 250.

In some embodiments, the flow balancer 250 can be a louver or louver panel that includes a plurality of slats. The vapor stream 280 flows through the clearance between the slats which creates pressure drop, for example, from friction, directional changes, or the like. In some embodiments, the louver panel can be a frameless panel that includes a plurality of slats or angled plates, angled relative to a longitudinal direction of the housing 210, the tube bundle 230, or the like. The angled plates can attach to the housing 210 of the evaporator 200. In some embodiments, the flow balancer 250 can be a perforated plate. In some embodiments, the perforated plate can have angled perforation to direct or angle the flow direction of the vapor stream to align the flow to balance the refrigerant quality.

It is appreciated that demisters are generally designed to remove droplets while minimizing pressure drop in the vapor stream 280. Typically, the pressure drop created by a wire mesh demister can be around 0.01-0.03 psi and tends to vary with the amount of liquid entering the demister or mist eliminator. In contrast, according to an embodiment, a flow balancer 259 (e.g., a louver panel) can selectively induce a pressure drop an order of magnitude larger than that of the demister. In some examples, the flow balancer 250 can selectively induce a pressure drop of 0.05-0.3 psi. In some embodiments, the flow balancer 250 induced pressure drop can be unaffected by the liquid load. Further, the effect of the pressure drop induced by the flow balancer 250 can be localized and concentrated over the segments where the vapor speed is high. In some embodiments, the flow balancer 250 balances the liquid level in the longitudinal direction of the housing. Increasing the liquid level, for example, in the segments 210A and 210C can reduce the portion of the tube bundle 230 in the vapor stream 280 thereby increasing the overall heat transfer rate of the evaporator 200 and/or proper wetting of the tube bundles.

It is appreciated that, as shown in FIG. 14, the flow balancer 250 is disposed on the first end 211 covering about half of evaporator 200. However, the flow balancer 250 can cover the full length of the evaporator 200 (e.g., from the first end 211 to the second end 212). The flow balancer 250 at segments with lower vapor flow rate would induce less pressure drop in the segments, thus allowing the threshold 215 to raise via the liquid mass migrating from higher vapor flow rate segments (e.g., 210B) and/or higher dT segments.

Figure 15:
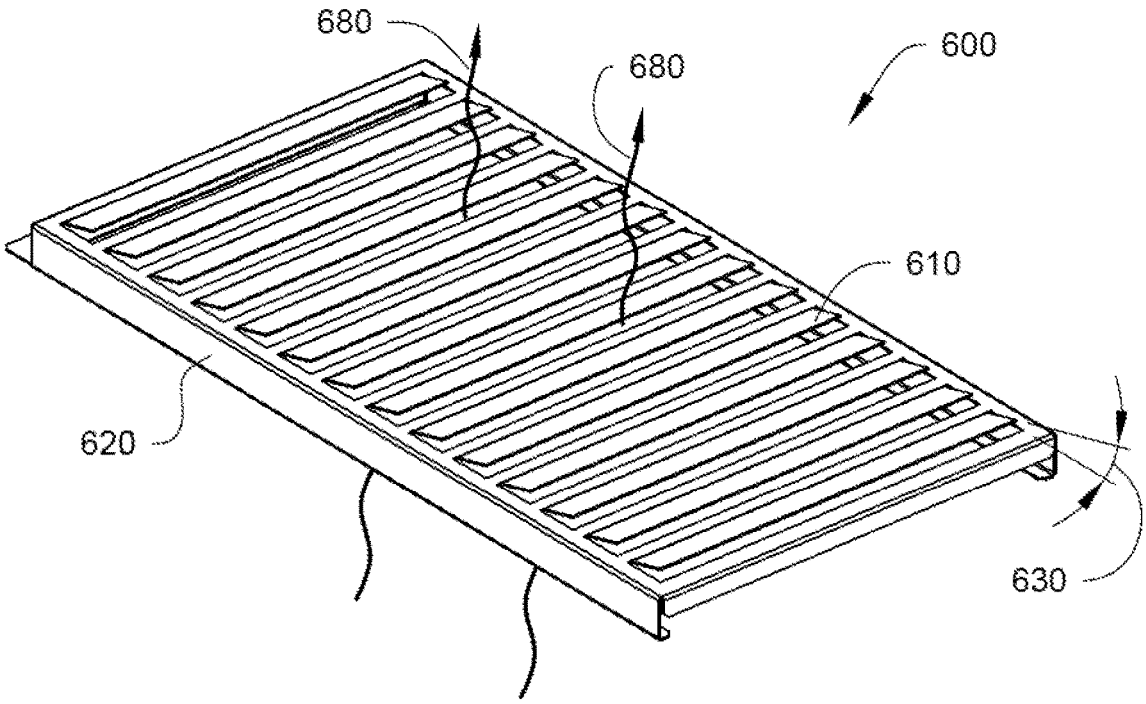
FIG. 15 is a perspective view of a flow balancer, according to an embodiment.
Figure 16:
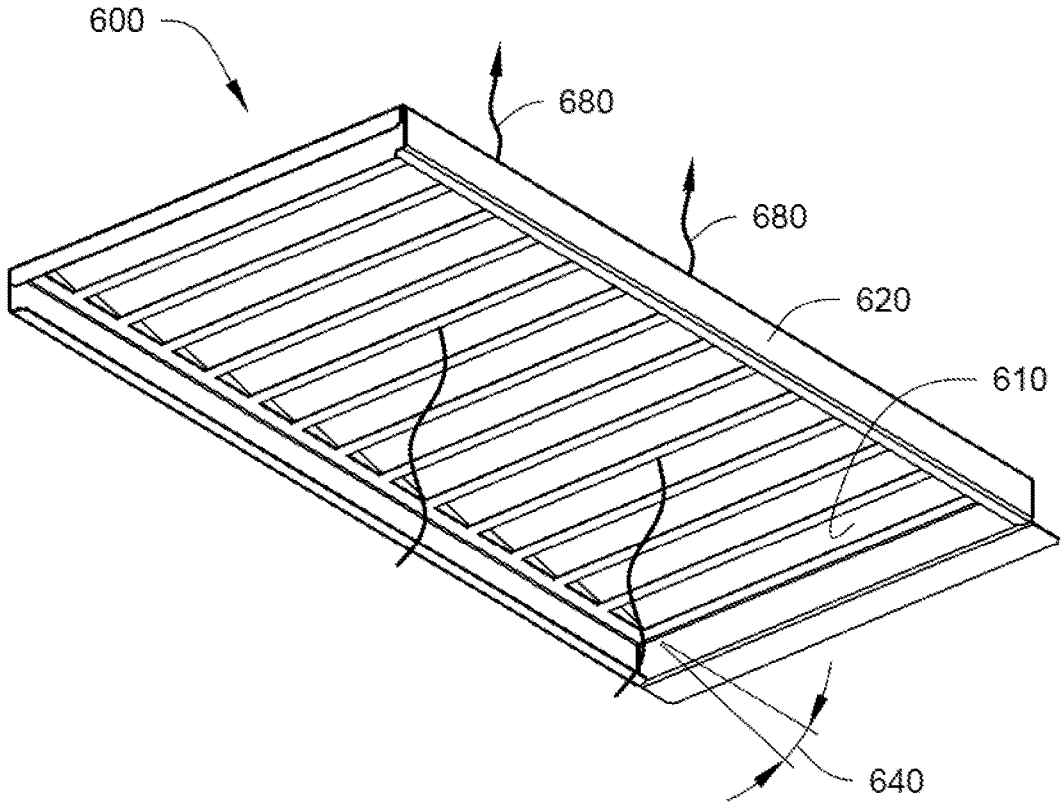
FIG. 16 is another perspective view of the flow balancer, according to the embodiment of FIG. 15.

FIG. 15 is a perspective view of a flow balancer 600, according to an embodiment. FIG. 16 is another perspective view of the flow balancer 600, according to the embodiment of FIG. 15. In some embodiments, the flow balancer 600 can be the flow balancer 250 as shown and described in FIGS. 10-14. In some embodiments, FIG. 15 can be the flow balancer 250 shown from above the flow balancer 250 (i.e., from the outlet 240 opposite of the direction D); and FIG. 16 can be the flow balancer 250 shown from below the flow balancer 250 (i.e., from the inlet 220 following the direction D).

As illustrated in FIGS. 14 and 15, the flow balancer 600 is a louver panel having a plurality of slats 610 attached to a frame 620 surrounding the slats 610. A vapor stream 680 can flow through the clearances between the slats 610, inducing a pressure drop across the flow balancer 600. In some embodiments, the vapor stream 680 can be the vapor stream 280 of FIG. 14.

In some embodiments, the slats 610 are arranged to have an angle 630 or 640 relative to the frame 620. The angle 630 or 640 can manage the vapor stream 680 to flow toward certain directions within the housing (e.g., housing 210) such that a vapor flow pattern and or vapor speed at the outlet 240 is more even, as further shown and described with respect to FIGS. 17 and 18.

It is appreciated that the angle 630 or 640 can be any degrees suitable for guiding the vapor stream 680 to exit from the housing (e.g., 210 of FIG. 10) via the outlet (e.g., 240 of FIG. 10). In some embodiments, the angle 630 and 640 can be arranged to face each other and/or facing in the direction of the outlet 240. In some embodiments, the angles 630 and 640 can be the same angle or have a varying pattern along the frame 620. For example, a varying pattern can include the angles 630 and 640 be smaller further away from the outlet 240 and be larger closer to the outlet 240. In some embodiments, the angles 630 and 640 can have fixed angles, for example, by the slats 610 fixedly attached to the frame 620. The slats 610 can be fixedly attached to the frame 620 by being formed from the same piece of metal sheet, welded, or the like. In some embodiments, the slats 610 can be configured such that the angles 630 and 640 are adjustable angles, for example, by attaching the slats 610 to the frame 620 via a pliable material, an adjustable structure (e.g., hinges), actuated by an actuator, or the like.

Figure 17A:
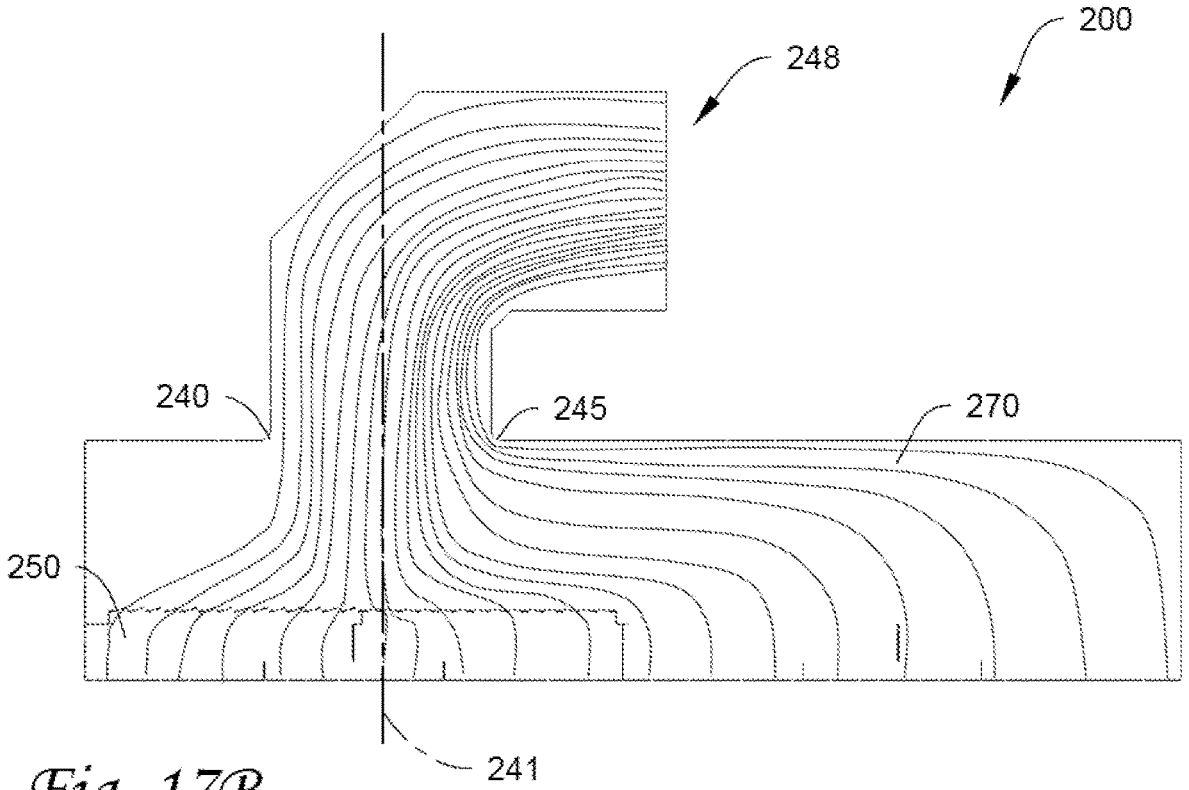
FIG. 17A is a longitudinal cross-sectional view of the evaporator showing the flow patterns of the vapor stream, according to an embodiment.
Figure 17B:
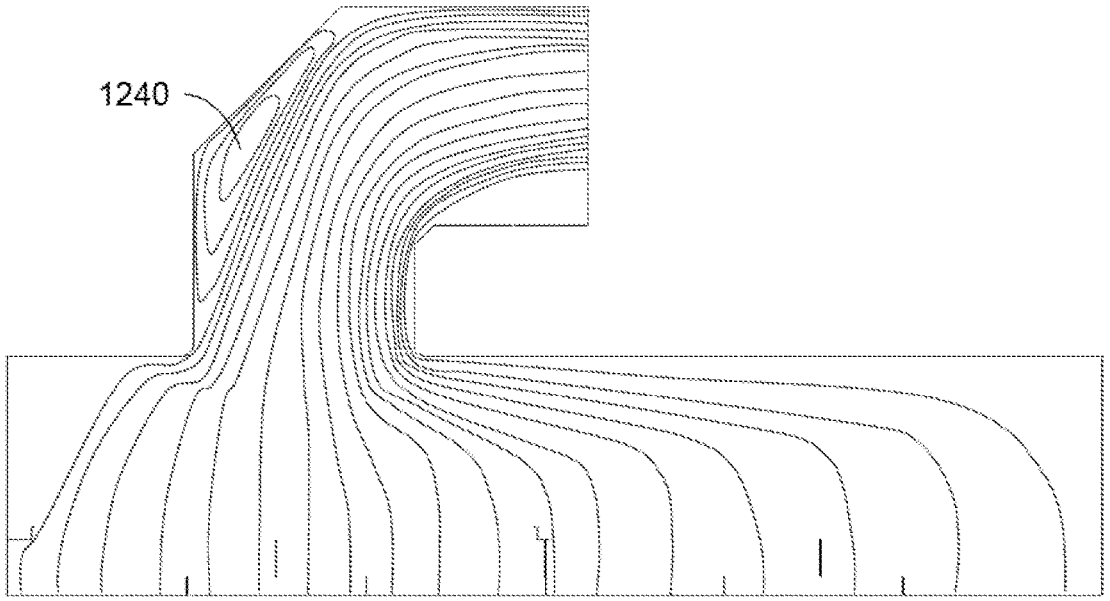
Fig. 17B (Prior Art)
FIG. 17B is a longitudinal cross-sectional view to show an evaporator that does not include the flow balancer.

FIG. 17A is a longitudinal cross-sectional view of the evaporator 200 showing the flow patterns of the vapor stream, according to an embodiment. In FIG. 17A the lines represent flow patterns, e.g., stream lines, of the vapor stream 280 in the evaporator 200 to show the effect of a flow balancer 250 on the flow pattern and/or the vapor speed of the vapor stream 280. The flow balancer 250 is configured such that the vapor stream 280 of the fluid is arranged to flow through the flow balancer 250 to align the flow of the vapor stream 280 to be a more uniformly distributed vapor stream passing the outlet of the housing, e.g., directed towards a center of the exit of the housing. The uniformity according to an embodiment (e.g., as shown in FIG. 17A) can be compared to that of a similar evaporator with the flow balancer 250 removed (e.g., as shown in FIG. 17B). For example, when the evaporator 200 includes the flow balancer 250, the flow is directed inwards and is aligned with respect to the outlet of the housing to have a less lossy passage of the vapor stream, or more uniformly distributed vapor stream, through the outlet. It is appreciated that a more uniformed flow is generally more preferable by any downstream equipment, such as the compressor.

FIG. 17B is provided to show an evaporator that does not include the flow balancer 250. As shown in FIG. 17B, when the flow balancer 250 is not provided, the flow is not redirected toward the outlet on the housing. As such, the flow may pinch or be narrowed near the exit at the outlet which causes a more lossy passage of the vapor stream, or less uniformly distributed vapor stream, e.g., a smaller portion of the outlet is used.

It is also appreciated that the flow of the vapor stream can result in a recirculation flow region (e.g., at 1240) in the conduit (e.g., 242 of FIG. 14) connecting the interior of the evaporator and the downstream equipment. The vapor stream can have a recirculation flow region, for example, due to the high vapor speed of the vapor stream due to the narrowing of the vapor stream in the conduit, e.g., due to the vapor stream not utilizing the entire width or diameter of the conduit and a pinch point of the vapor stream created at the refrigerant outlet of the evaporator. At 1240 the flow of the vapor stream can be cyclical and ineffective in conducting vapor stream from the evaporator to the downstream equipment. As a result, the circulation flow region 1240 can occupy a volume in the conduit such that the volume available for the flowing vapor stream is reduced from the internal volume of the conduit.

As such, comparing FIGS. 17A and 17B, the evaporator that includes the flow balancer 250 can align the vapor stream 280 to flow more toward a center 241 of the outlet 240, reducing the high flow rate concentrated at a pinch point 245 of the flow path located on the outlet 240. Furthermore, the flow pattern at a location 248 that is downstream from the pinch point 245 can be more uniform as shown in FIG. 17A, compared to the same location at 248 without the flow balancer 250 as shown in FIG. 17B.

In some embodiments, as shown by comparing FIGS. 17A and 17B, the flow balancer 250 can reduce or eliminate the recirculation flow region and make more of the interior volume of the conduit available for conducting the vapor stream flowing through the conduit. More volume available for the vapor stream to flow through generally correlates with slower vapor velocities and lower frictional losses in the conduit such that the overall efficiency of the HVACR system can be improved over a HVACR system configured with an evaporator without the flow balancer.

Figure 18A:
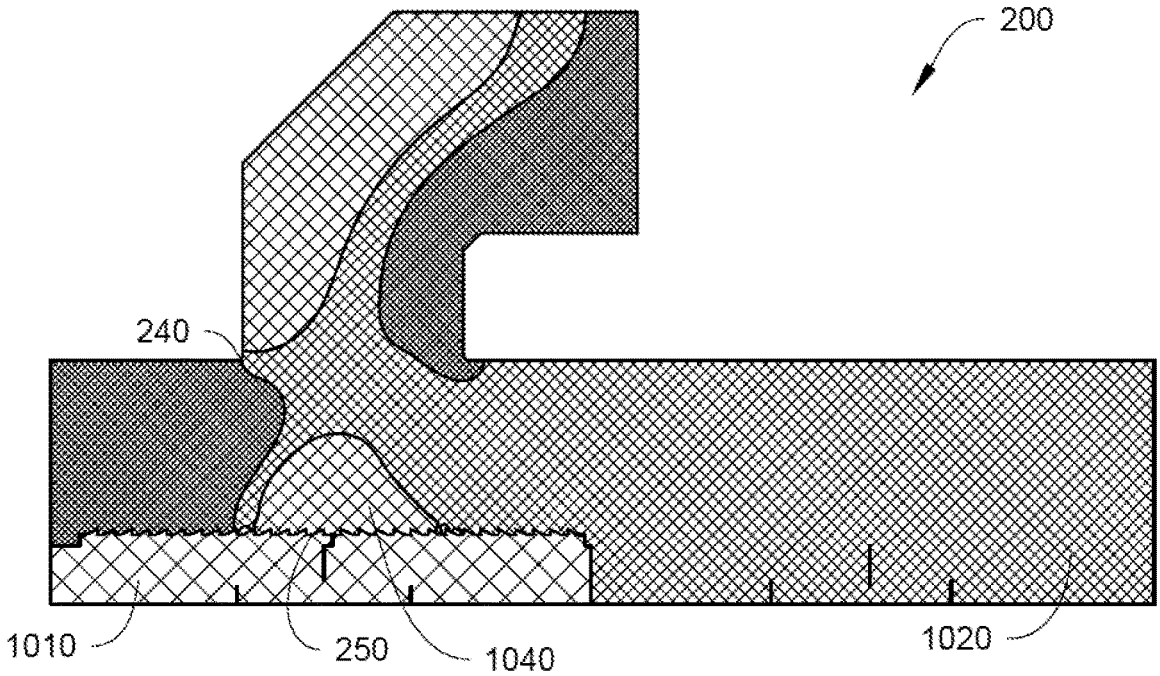
FIG. 18A is a longitudinal cross-sectional views of the evaporator showing static pressure in the evaporator, according to an embodiment.
Figure 18B:
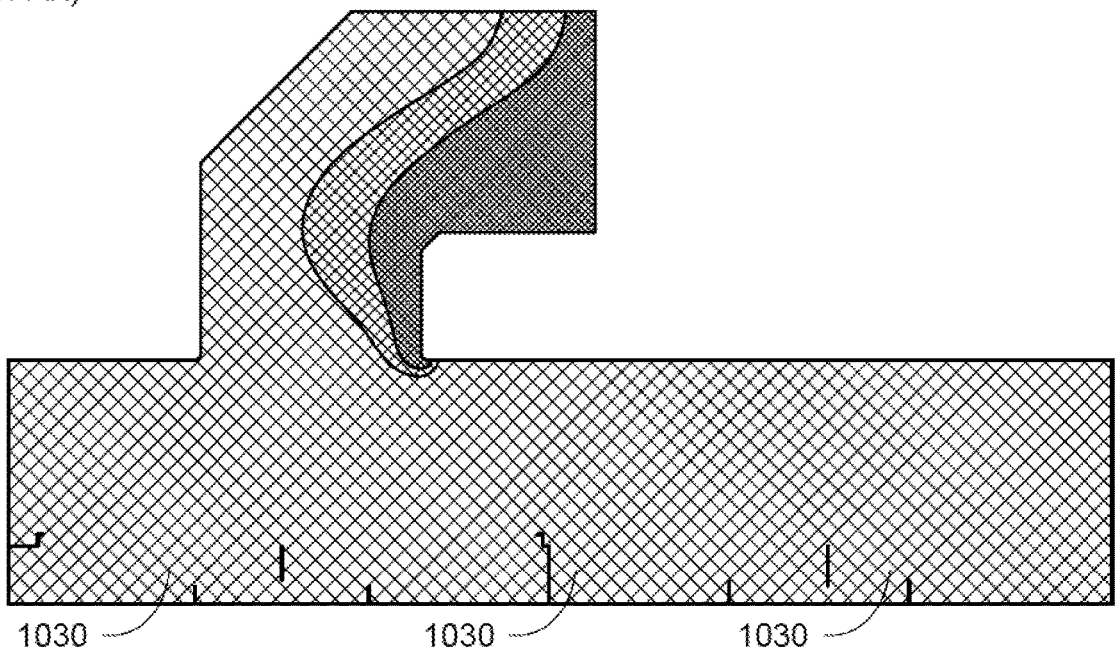
Fig. 18B (Prior Art)
FIG. 18B is a longitudinal cross-sectional view of an evaporator that does not include the flow balancer.

Similarly, FIGS. 18A and 18B are longitudinal cross-sectional views of the evaporator 200 showing static pressure in the evaporator 200, according to an embodiment.

In FIG. 18A, the shadings represent different static pressure within the housing 210 of the evaporator 200. The flow balancer 250 is disposed in the housing 210. The area 1010 has the highest static pressure, the area 1040 has less static pressure, and the area 1020 has the least static pressure among the area 1020, 1040, and 1010, e.g., the portion of the tube bundle under the flow balancer 250 has the highest pressure.

In FIG. 18B, the magnitude of static pressure is pattern matched with FIG. 18A. As shown in FIG. 18B, the flow balancer 250 is not provided. The static pressure along the longitudinal direction of the housing is relatively similar, and similar to the static pressure at 1040 of FIG. 18A.

It is appreciated that the static pressure at 1020 is shown to be lower than that at 1030. Accordingly, by including the flow balancer 250 that aligns the flow of the vapor stream, the static pressure at 1020 can be reduced to increase the heat exchange between the working fluid and the process fluid. For example, as compared with the evaporator of FIG. 18B, the tube bundle at 1020 can have lower static pressure, lower saturation temperature, higher rate of evaporator, more entrained droplets, and better wetted upper tubes, and thereby, higher efficiency of heat transfer.

Aspects

It is noted that any of aspects 1-9 can be combined with any of aspects 10-18 and any of aspects 19-20.

Aspect 1. An evaporator, comprising:

a housing having a first end longitudinally opposing a second end;

an inlet disposed on the housing and configured to receive a fluid;

a tube bundle disposed in the housing and configured to evaporate the fluid to provide a vapor stream arranged to exit through an outlet on the housing; and a flow balancer provided between the tube bundle and the outlet on the housing, the flow balancer being configured to balance refrigerant quality between the first end and the second end of the evaporator by controlling the vapor stream.

Aspect 2. The evaporator of aspect 1, wherein the flow balancer is configured to provide a selected pressure drop along a selected segment of the tube bundle.

Aspect 3. The evaporator of aspect 1 or 2, wherein the flow balancer is configured to direct the flow of the vapor stream longitudinally toward the outlet.

Aspect 4. The evaporator of any one of aspects 1-3, further comprising a demister disposed in the housing and configured to remove entrained droplets from the vapor stream, wherein the flow balancer is disposed between the demister and the outlet.

Aspect 5. The evaporator of any one of aspects 1-4, wherein the vapor stream of the fluid is arranged to flow through the flow balancer and induce a selected pressure drop in a selected segment of the tube bundle, affecting the bundle exit quality of the fluid in the selected segment.

Aspect 6. The evaporator of any one of aspects 1-5, wherein the vapor stream of the fluid is arranged to flow through the flow balancer to align the flow of the vapor stream to be a more uniformly distributed vapor stream passing the outlet of the housing.

Aspect 7. The evaporator of any one of aspects 1-6, wherein the flow balancer comprises a plurality of angled slats.

Aspect 8. The evaporator of any one of aspects 1-7, wherein the flow balancer comprises a perforated plate.

Aspect 9. The evaporator of any one of aspects 1-8, wherein the inlet is disposed at the lower portion of the housing.

Aspect 10. A heating, ventilation, air conditioning, or refrigeration (HVACR) system, comprising an evaporator arranged to evaporate a fluid to a vapor stream, wherein the evaporator comprises:

a housing having a first end longitudinally opposing a second end;

an inlet disposed on the housing and configured to receive a fluid;

a tube bundle disposed in the housing and configured to evaporate the fluid to provide a vapor stream arranged to exit through an outlet on the housing; and a flow balancer provided between the tube bundle and the outlet on the housing, the flow balancer being configured to balance refrigerant quality between the first end and the section end of the evaporator by controlling the vapor stream.

Aspect 11. The HVACR system of aspect 10, wherein the flow balancer is configured to provide a selected pressure drop along a selected segment of the tube bundle.

Aspect 12. The HVACR system of aspect 10 or 11, wherein the flow balancer is configured to direct the flow of the vapor stream longitudinally toward the outlet.

Aspect 13. The HVACR system of any one of aspects 10-12, further comprising a demister disposed in the housing and configured to remove entrained droplets from the vapor stream, wherein the flow balancer is disposed between the demister and the outlet.

Aspect 14. The HVACR system of any one of aspects 10-13, wherein the vapor stream of the fluid is arranged to flow through the flow balancer to induce a selected pressure drop along a selected segment of the tube bundle, affecting the distribution of the bundle exit quality.

Aspect 15. The HVACR system of any one of aspects 10-14, The HVACR system of claim 10, wherein the vapor stream of the fluid is arranged to flow through the flow balancer to align the flow of the vapor stream to be a more uniformly distributed vapor stream passing the outlet of the housing.

Aspect 16. The HVACR system of any one of aspects 10-15, wherein the flow balancer comprises a plurality of angled slats.

Aspect 17. The HVACR system of any one of aspects 10-16, wherein the flow balancer comprises a perforated plate.

Aspect 18. The HVACR system of any one of aspects 10-17, wherein the inlet is disposed at the lower portion of the housing.

Aspect 19. A method of operating an evaporator, comprising receiving a fluid from an inlet disposed on the housing having a first end longitudinally opposing a second end;

evaporating the fluid with a tube bundle disposed in the housing, providing a vapor stream of the fluid;

balancing refrigerant quality between the first end and the second end of the evaporator by controlling the vapor stream; and exiting the vapor stream through the outlet.

Aspect 20. The method of aspect 19, further comprising:

flowing the vapor stream through a demister to remove entrained droplets from the vapor stream, wherein the flow balancer is disposed between the demister and an outlet disposed on the housing.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. An evaporator, comprising:

a housing having a first end longitudinally opposing a second end;

an inlet disposed on the housing and configured to receive a fluid;

a tube bundle disposed in the housing and configured to evaporate the fluid to provide a vapor stream arranged to exit through an outlet on the housing; and a flow balancer provided between the tube bundle and the outlet on the housing, the flow balancer being configured to balance refrigerant quality of the fluid between the first end and the second end of the evaporator by controlling the vapor stream, wherein the flow balancer includes one or more angled channels that align a flow of the vapor stream, wherein the flow balancer is configured to arrange the flow of the vapor stream to flow through the one or more angled channels, toward the outlet of the housing such that the vapor stream is uniformly distributed at the outlet of the housing.

2. The evaporator of claim 1, wherein the one or more angled channels is configured to provide a selected pressure drop along a selected segment of the tube bundle.

3. The evaporator of claim 1, wherein the one or more angled channels is configured to direct the flow of the vapor stream longitudinally toward the outlet.

4. The evaporator of claim 1, further comprising a demister disposed in the housing and configured to remove entrained droplets from the vapor stream, wherein the flow balancer is disposed between the demister and the outlet.

5. The evaporator of claim 1, wherein the flow balancer is further configured such that the vapor stream of the fluid is arranged to flow through the flow balancer and induce a selected pressure drop in a selected segment of the tube bundle.

6. The evaporator of claim 1, wherein the one or more angled channels of the flow balancer comprises a plurality of angled slats.

7. The evaporator of claim 1, wherein the one or more angled channels of the flow balancer comprises a perforated plate.

8. The evaporator of claim 1, wherein the inlet is disposed at a lower portion of the housing.

9. A heating, ventilation, air conditioning, or refrigeration (HVACR) system, comprising an evaporator arranged to evaporate a fluid to a vapor stream, wherein the evaporator comprises:

a housing having a first end longitudinally opposing a second end;

an inlet disposed on the housing and configured to receive a fluid;

a tube bundle disposed in the housing and configured to evaporate the fluid to provide a vapor stream arranged to exit through an outlet on the housing; and a flow balancer provided between the tube bundle and the outlet on the housing, the flow balancer being configured to balance refrigerant quality between the first end and the second end of the evaporator by controlling the vapor stream, wherein the flow balancer includes one or more angled channels that align a flow of the vapor stream, wherein the flow balancer is configured to arrange the flow of the vapor stream to flow through the one or more angled channels, toward the outlet of the housing such that the vapor stream is uniformly distributed at the outlet of the housing.

10. The HVACR system of claim 9, wherein the one or more angled channels is configured to provide a selected pressure drop along a selected segment of the tube bundle.

11. The HVACR system of claim 9, wherein the one or more angled channels is configured to direct the flow of the vapor stream longitudinally toward the outlet.

12. The HVACR system of claim 9, further comprising a demister disposed in the housing and configured to remove entrained droplets from the vapor stream, wherein the flow balancer is disposed between the demister and the outlet.

13. The HVACR system of claim 9, wherein the flow balancer is further configured such that the vapor stream of the fluid is arranged to flow through the flow balancer to induce a selected pressure drop along a selected segment of the tube bundle.

14. The HVACR system of claim 9, wherein the one or more angled channels of the flow balancer comprises a plurality of angled slats.

15. The HVACR system of claim 9, wherein the one or more angled channels of the flow balancer comprises a perforated plate.

16. The HVACR system of claim 9, wherein the inlet is disposed at a lower portion of the housing.

17. A method of operating an evaporator, comprising receiving a fluid from an inlet disposed on a housing having a first end longitudinally opposing a second end;

evaporating the fluid with a tube bundle disposed in the housing, providing a vapor stream of the fluid;

balancing refrigerant quality between the first end and the second end of the evaporator by controlling the vapor stream;

aligning a flow of the vapor stream, wherein a flow balancer is configured to arrange the flow of the vapor stream to flow through one or more angled channels of the flow balancer, toward an outlet of the housing such that the vapor stream is uniformly distributed at the outlet of the housing; and exiting the vapor stream through the outlet.

18. The method of claim 17, further comprising:

flowing the vapor stream through a demister to remove entrained droplets from the vapor stream, wherein the flow balancer is disposed between the demister and the outlet disposed on the housing.

* * * * *